US012624911B1

(12) United States Patent
Herring

(10) Patent No.: US 12,624,911 B1
(45) **Date of Patent: *May 12, 2026**

(54) FIREARM RECEIVER ASSEMBLY WITH AMMUNITION BELT FEEDING CAPABILITY AND FIREARM COMPRISING SAME

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/379,058

(22) Filed: Nov. 4, 2025

Related U.S. Application Data

(63) Continuation of application No. 19/197,104, filed on May 2, 2025.

(51) Int. Cl.
*F41A 9/32* (2006.01)
*F41A 3/66* (2006.01)

(52) U.S. Cl.
CPC ..... *F41A 9/32* (2013.01); *F41A 3/66* (2013.01)

(58) Field of Classification Search
CPC ..... F41A 9/29; F41A 9/30; F41A 9/31; F41A 9/32; F41A 9/33
See application file for complete search history.

(56) References Cited

U.S. PATENT DOCUMENTS

| | | | | |
|---|---|---|---|---|
| 1,293,021 | A | 2/1919 | Browning | |
| 1,628,226 | A | 5/1927 | Browning | |
| 2,845,001 | A | 7/1958 | Hillberg | |
| 4,942,802 | A * | 7/1990 | Stoner | F41A 9/32 89/33.14 |
| 6,634,274 | B1 * | 10/2003 | Herring | F41A 5/26 89/33.14 |
| 10,746,493 | B1 * | 8/2020 | Steimke | F41A 9/29 |
| 11,156,415 | B2 * | 10/2021 | Franssen | F41A 9/59 |
| 11,268,774 | B1 | 3/2022 | Landies et al. | |
| 11,365,944 | B2 * | 6/2022 | Franssen | F41A 9/32 |

(Continued)

FOREIGN PATENT DOCUMENTS

| | | |
|---|---|---|
| EP | 3477239 | 1/2019 |
| WO | 2021045851 | 3/2021 |

OTHER PUBLICATIONS

M37: The Ultimate Improved Browning 1919; https://surplused.com/index.php/2019/03/08/m37-the-ultimate-improved-browning-1919; Mar. 8, 2019; www.surplused.com; [Retrieved Jun. 27, 2025].

(Continued)

*Primary Examiner* — Gabriel J. Klein
(74) *Attorney, Agent, or Firm* — David O. Simmons; IVC Patent Agency

(57) ABSTRACT

A firearm receiver assembly comprises a receiver body, a top cover, and an ammunition advancing mechanism mounted on the top cover. The top cover is pivotably attached at a mounting portion thereof to a mounting portion of a receiver body for enabling the top cover to be pivotable about a top cover pivot axis between an open position and a closed position with respect to the receiver body. The top cover pivot axis extends parallel to a bore axis of the receiver body.

23 Claims, 14 Drawing Sheets

(56) References Cited

U.S. PATENT DOCUMENTS

| | | | | |
|---|---|---|---|---|
| 11,598,600 | B2 | 3/2023 | Landies et al. | |
| 11,879,702 | B2 | 1/2024 | Frassen et al. | |
| 12,092,414 | B2 | 9/2024 | Steimke et al. | |
| 12,504,245 | B1 * | 12/2025 | Herring | F41A 3/66 |
| 2019/0331450 | A1 | 10/2019 | Steimke et al. | |
| 2019/0339032 | A1 * | 11/2019 | Barrett | F41A 3/66 |
| 2020/0271404 | A1 * | 8/2020 | Franssen | F41A 3/66 |

OTHER PUBLICATIONS

MG34 reversible feeds; https://www.k98kforum.com/threads/mg34-reversible-feeds.3046/; Sep. 11, 2011; www.k98kforum.com; [Retrieved Jun. 27, 2025].

The HK21E, HKs best Beltfed; https://www.youtube.com/watch?v=no63zaxmBGE; Sep. 25, 2021; www.youtube.com; [Retrieved Jun. 27, 2025].

M240C; https://www.usord.com/weapons/m240c; 2025; www.usord.com; [Retrieved Jun. 27, 2025].

Ohio Ordnance Works REAPR MG—The "Grim Reaper" from the USA prefers the .338 Norma Magnum caliber. Why ?; https://www.all4shooters.com/en/shooting/pro-zone/ohio-ordnance-works-reapr-mg-in-norma-magnum/; Feb. 28, 2024; www.all4shooters.com; [Retrieved Jun. 27, 2025].

Nawe_Mario, KAC is Refreshing Its MG, https://wmasg.com/en/articles/view/9639, Oct. 15, 2019, Retrieved May 2, 2025].

* cited by examiner

FIREARM RECEIVER ASSEMBLY WITH AMMUNITION BELT FEEDING CAPABILITY AND FIREARM COMPRISING SAME

FIELD OF THE DISCLOSURE

The disclosures herein relate generally to firearms, and more particularly to firearm receivers with belt-feed capability.

BACKGROUND

Many firearms commonly used by law enforcement and/or military personnel are designed by their manufacturers for receiving ammunition exclusively from an ammunition magazine. The AR15 family of firearms, including the M16 and M4 type firearms, illustrate examples of rifles and carbines that are designed by their manufacturers to receive ammunition exclusively from an ammunition magazine. M16 and M4 type firearms are a military version of the AR15 family of firearms capable of operating in a fully automatic or select-fire mode. M16 and M4 type firearms have been manufactured by companies including, but not limited to Colt Defense, FN Manufacturing, LMT Defense, Heckler & Koch and others. AR rifles, which are operable only in semi-automatic mode, are commercially-available from numerous manufacturers in civilian markets.

Some magazine-fed firearms, such as M16 and M4 type firearms, are operable in a fully automatic mode. When being operated in the fully automatic mode, firing of a round of ammunition automatically facilitates ejection of each spent round from the firing chamber and chambering of a new round into the firing chamber. As long as the trigger of such a firearm is depressed, the firearm will continue to fire until all available ammunition in an ammunition magazine is depleted.

Due to the attainable firing rate of firearms operated in a fully automatic mode and the limited ammunition capacity of standard ammunition magazines, the use of ammunition magazines with such firearms results in a significant amount of down-time of the firearm for allowing a depleted magazine to be replaced with a full ammunition magazine. Most automatic firearms are capable of firing ammunition at a rate of 150 rounds or more per minute. At a firing rate of 150 rounds per minute, a 30-round ammunition magazine can be depleted of ammunition in as little as about 12 seconds of continuous firing. In many situations, such as in military combat, a high-capacity ammunition delivery system such as a belt-feed system is preferred over an ammunition magazine. A typical ammunition belt for a belt-feed system holds 200 or more rounds of ammunition. At a firing rate of 150 rounds per minute, a 200 round ammunition belt can be depleted in as little as about 80 seconds. Accordingly, for a given firearm design, the minimum time to depletion of a 200 round ammunition belt is as much as about 7 times greater than that of a 30-round ammunition magazine. As a result of the increased time to depletion, belt-feed ammunition systems are preferred in many military situations.

It is known in the art that some magazine-fed firearms that have been modified to accept belt-feed ammunition, including the AR15, M16 and M4 firearms discussed above, do not require modification of the lower receiver assembly for facilitating belt-feed operation, and have in fact retained magazine feed capability in the process. Advantageously, such "dual-feed" firearms are operable with both magazine feed ammunition and belt-feed ammunition, without modification of the firearm lower receiver. An example of such a dual-feed" firearm is disclosed in U.S. Pat. No. 6,634,274, which is incorporated herein in its entirety by reference. Notably, the lower receiver assembly of many firearms, such as AR15, M16, and M4 type firearms, is the registerable portion of the firearm that carries a serial number for enabling compliance with registration requirements of the United States Bureau of Alcohol, Tobacco & Firearms. As a result of the lower receiver assembly being the portion of the firearm that is registerable, for commercial purposes it can only be modified legally by a licensed firearm manufacturer.

It is also known in the art that various types of optics devices may be beneficially utilized on firearms, such as AR15, M16, and M4 type firearms, to boost the effective capability of the firearms by permitting more effective engagement of targets during the day or night and at increased ranges. Examples of these optics devices include, but are not limited to, magnified optical sights and night vision (e.g., thermal) equipment. Regardless of the specific type of optics devices, it is common for two different optics (i.e., accessory) devices to be serially positioned on a firearm such as via MIL-STD-1913 "Picatinny" rails that are unitarily-formed with or attached to a handguard or receiver of the firearm. In the case of a belt-fed firearm having a belt-feed cover, it is desirable for a first optics device to be mounted on the belt-feed cover and a second optics device to be mounted forward of the belt-feed cover on a handguard or receiver of the firearm. For example, the first optics device may be a primary "day" optics device and the second optics device may be a thermal imager or night vision device, thereby allowing the primary day optic to see through the thermal imager or night vision device.

Conventional belt-feed arrangements for handheld firearms have an ammunition belt feeding apparatus cover that is mounted on top of a receiver of the firearm (e.g., the firearm's bolt-carrying receiver). The ammunition belt feeding apparatus cover of such conventional belt-feed arrangements is mounted on a pivot pin at a forward end portion of the ammunition belt feeding apparatus cover with a pivot axis that is perpendicular (i.e., transverse) to and above the bore axis centerline. This pivot axis location and orientation results in the ammunition belt feeding apparatus cover pivoting about the axis of the pivot pin thereby tilting the rear end portion of the ammunition belt feeding apparatus cover up and rotating it forward. Thus, when the firearm is fitted with serial-positioned optics devices as described above where one of the optics devices is mounted on a handguard of the firearm and the other optics device mounted on the ammunition belt feeding apparatus cover immediately behind the first optics device, the optics devices are known to collide with each other when the ammunition belt feeding apparatus cover is opened to facilitate loading of an ammunition belt. Additionally, the length of the conventional ammunition belt feeding apparatus covers and their pivot axis orientation results in excessive total opening height of the ammunition belt feeding apparatus cover required for installing a new ammunition belt thereby potentially exposing a shooter to enemy fire or otherwise exposing the shooter to an adverse actor. In at least these respects, serial-positioned optics devices can be an impediment to efficient and effective use of conventional belt-feed arrangements as can be the transverse pivot axis orientation of such conventional belt-feed arrangements.

Therefore, an ammunition belt feeding apparatus cover arrangement that overcomes drawbacks associated with conventional belt-feed arrangements would be advantageous, desirable and useful.

SUMMARY OF THE DISCLOSURE

Embodiments of the disclosures made herein are directed to an ammunition belt feeding apparatus cover arrangement that overcomes drawbacks associated with conventional belt-feed arrangements that have a pivot pin at a forward end portion of the ammunition belt feeding apparatus cover with a pivot axis that is perpendicular to and above the bore axis centerline. To this end, ammunition belt feeding apparatus cover arrangement in accordance with embodiments of the disclosures made herein have a pivot pin at a side portion of the ammunition belt feeding apparatus cover with a pivot axis that extends parallel to a bore axis centerline of a firearm. Such an ammunition belt feeding apparatus cover arrangement alleviates several drawbacks associated with conventional belt-feed arrangements. One example of such a drawback is colliding of serial-positioned optics devices mounted respectively on the handguard and the ammunition belt feeding apparatus cover when the ammunition belt feeding apparatus cover is moved from its closed position toward its open position for facilitating loading of an ammunition belt. Another example of such drawbacks is excessive total opening height of the ammunition belt feeding apparatus cover required for installing a new ammunition belt.

In one or more embodiments, an ammunition belt feeding apparatus comprises an ammunition advancing mechanism and a top cover (i.e., the ammunition belt feeding apparatus cover). The ammunition advancing mechanism is operable to advance an ammunition feed belt along an ammunition feeding direction. The top cover includes at least one mounting body and has the ammunition advancing mechanism mounted thereon. The at least one mounting body enables the top cover to be pivotably attach a mating interface portion of a receiver body. The at least one mounting body defines a top cover pivot axis about which the top cover is pivotable. The top cover pivot axis extends perpendicularly to the ammunition feeding direction.

In one or more embodiments, a firearm receiver assembly comprises a receiver body, a top cover, and an ammunition advancing mechanism mounted on the top cover. The top cover is pivotably attached at a mounting portion thereof to a mounting portion of the receiver body for enabling the top cover to be pivotable about a top cover pivot axis extending parallel to a bore axis of the receiver body between an open position and a closed position with respect to the receiver body.

In one or more embodiments, a firearm receiver system comprises a lower receiver assembly including a lower receiver body and an upper receiver assembly including an ammunition belt feeding apparatus and an upper receiver body. The lower receiver body includes at least one of a magazine well configured for enabling ammunition from an ammunition magazine engaged therewith to be supplied from the lower receiver assembly and a trigger enabling the ammunition to be discharged. The upper receiver body is detachably attachable to the lower receiver body. The ammunition belt feeding apparatus is configured for enabling ammunition from an ammunition belt engaged therewith to be delivered into the interior space of the upper receiver body. The ammunition belt feeding apparatus includes a top cover pivotably attached to the upper receiver body for being pivotable about a top cover pivot axis. The top cover pivot axis extends parallel to a bore axis of the upper receiver assembly between an open position and a closed position with respect to the upper receiver body. An ammunition advancing mechanism of the belt feed assembly is operably attached to the top cover whereby the ammunition advancing mechanism moves in its entirety with the top cover when the top cover is moved between the open position and the closed position.

In one or more embodiments, a feed lever and a feed pawl yoke are provided, the feed pawl yoke is pivotably mounted on the top cover, the ammunition advancing mechanism is a shuttle feed ammunition advancing mechanism, the feed lever is movable engaged with the feed pawl yoke whereby pivotal movement of the feed lever about a pivot axis thereof causes a corresponding pivotal movement of the feed pawl yoke about a pivot axis thereof, and the feed pawl yoke is movable engaged with the ammunition advancing mechanism whereby the corresponding pivotal movement of the feed lever about the pivot axis thereof causes a corresponding linear movement of feed pawl bodies of the shuttle feed ammunition advancing mechanism In one or more embodiments, a drive shaft assembly is rotatably mounted on the top cover, the ammunition advancing mechanism is a sprocket feed ammunition advancing mechanism, and the drive shaft assembly is movable engaged with a feed sprocket of the sprocket feed ammunition advancing mechanism whereby movement of the drive shaft assembly in at least a first rotational direction about a rotation axis thereof causes a corresponding rotational movement of a feed sprocket about the rotation axis.

In one or more embodiments, a feed pawl yoke is pivotably mounted on the top cover to pivot about a feed pawl yoke pivot axis extending perpendicular to an ammunition advancing mechanism mounting surface of the top cover and a feed lever is pivotable about a feed lever pivot axis extending in a fixed perpendicular direction relative to the top cover pivot axis whereby the feed lever pivot axis remains in a fixed orientation relative to the top cover pivot axis as the top cover is pivoted about the top cover pivot axis.

In one or more embodiments, the top cover is pivotable about the top cover pivot axis between a closed position and an open position, the feed lever pivot axis extends through the feed lever at a first end portion thereof, the feed pawl yoke is pivotably attached at a central portion thereof to the top cover to pivot about the feed pawl yoke pivot axis, the feed pawl yoke includes a feed lever engaging body at a first end portion thereof, the feed lever includes a feed lever engaging body receptacle at a second end portion thereof, and the feed lever engaging body is engaged within the feed lever engaging body receptacle when the top cover is in the closed position and becomes disengaged from within the feed lever engaging body receptacle as the top cover is pivoted from the closed position to the open position.

In one or more embodiments, a feed lever is pivotably mounted on the top cover; and a feed pawl yoke pivotably mounted on the top cover.

In one or more embodiments, the feed pawl yoke is engaged with feed pawl bodies of the ammunition advancing mechanism and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

In one or more embodiments, the feed lever is pivotably attached at a first end portion thereof to the top cover to pivot about a feed lever pivot axis, the feed pawl yoke is pivotably attached at a central portion thereof to the top cover to pivot about a feed pawl yoke pivot axis, and the ammunition advancing mechanism includes a feed pawl assembly slidably attached to the top cover to enable feed pawl bodies thereof to each move along a respective linear translation axis thereof extending parallel to the ammunition feeding direction.

In one or more embodiments, the ammunition advancing mechanism includes a feed lever pivotably attached at a first end portion thereof to the top cover to pivot about a feed lever pivot axis and the feed lever includes a feed stud depressing portion at a second end portion thereof.

In one or more embodiments, a bolt carrier is within a bolt carrier receiving bore of the receiver body (e.g., upper receiver body) for enabling the bolt carrier to move between a battery-enabling position and a rearwardly displaced position, a feed stud assembly includes a feed stud housing and a feed stud at an upper surface of the feed stud housing, the feed stud housing is fixedly attached to the bolt carrier for enabling the feed stud assembly to move in concert with the bolt carrier between the battery-enabling position and the rearwardly displaced position, the ammunition advancing mechanism includes a feed lever pivotably attached to the top cover, the feed stud is spring-biased to move between an extended position relative to the upper surface and a depressed position relative to the upper surface, the feed stud resides in a feed lever channel of the feed lever when the feed stud is in the extended position during movement of the bolt carrier between a battery-enabling position and a recoil position with the top cover in a closed position with respect to the receiver body, the feed lever is spring-biased to a reset position with the top cover in an open position with respect to the receiver body, and the feed stud is retained in the depressed position by a feed stud depressing portion of the feed lever when the feed lever is in the reset position and the top cover in the closed position.

In one or more embodiments, the receiver is an AR15, M16, or M4 upper receiver.

In one or more embodiments, the receiver body is an upper receiver body of a split receiver system.

In one or more embodiments, the mounting portion of the receiver body is a unitarily-formed structure of the receiver body and the top cover pivot axis extends through the mounting portion of the receiver body.

In one or more embodiments, guide bodies are within a feed stud housing channel of the upper receiver body, the feed stud housing is constrained between the guide bodies, and feed stud housing engaging surfaces of each guide bodies have a plurality of friction-reducing discontinuities formed therein.

In one or more embodiments, the guide bodies are made of a material that is dissimilar to the receiver body.

In one or more embodiments, adjacent protrusions jointly form one of the friction-reducing discontinuities therebetween.

These and other objects, embodiments, advantages and/or distinctions of the present invention will become readily apparent upon further review of the following specification, associated drawings and appended claims.

DETAILED DESCRIPTION

Figure 1:
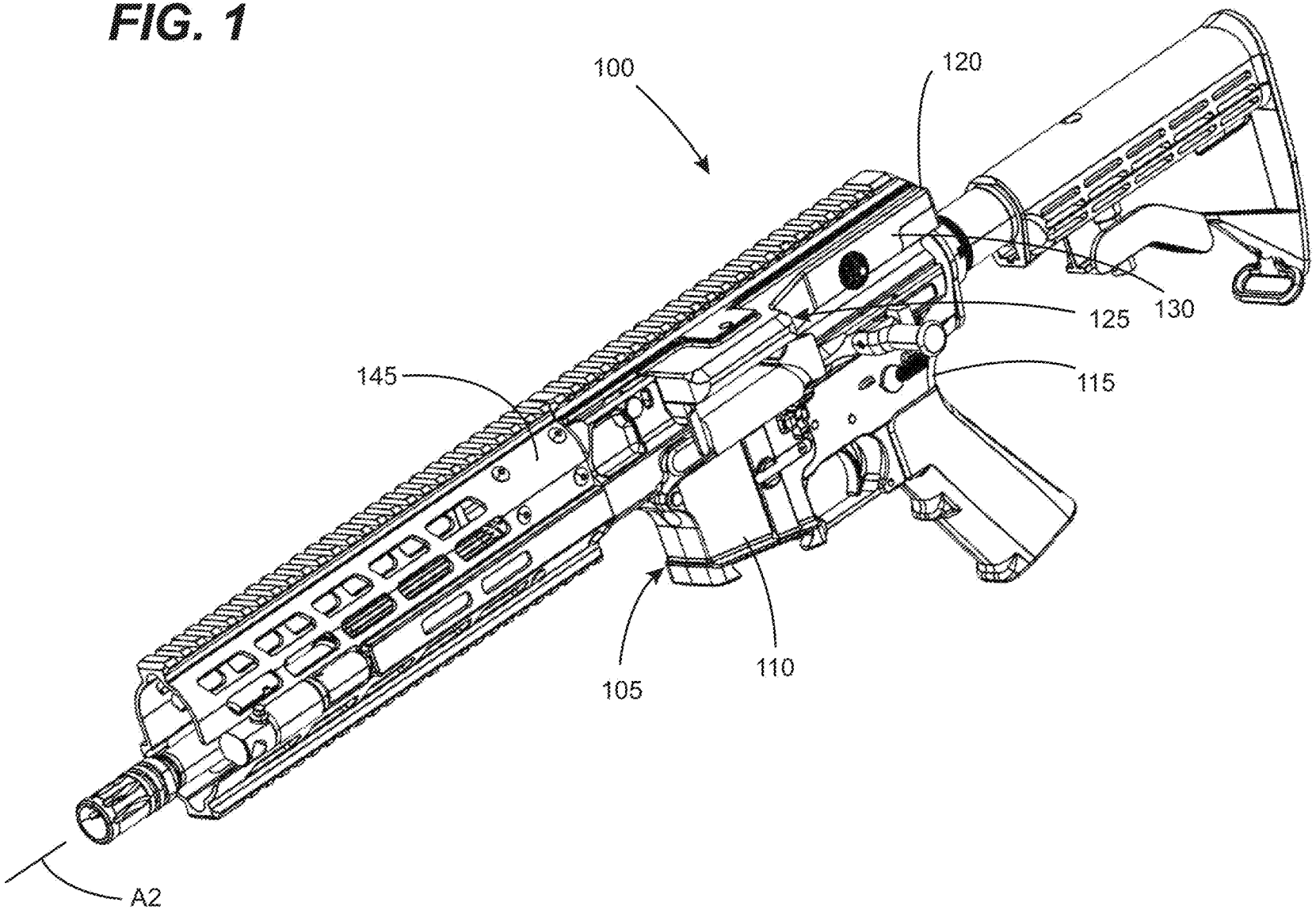
FIG. 1 is a first perspective view of a firearm having a receiver assembly in accordance with a first embodiment of the disclosures made herein.
Figure 2:
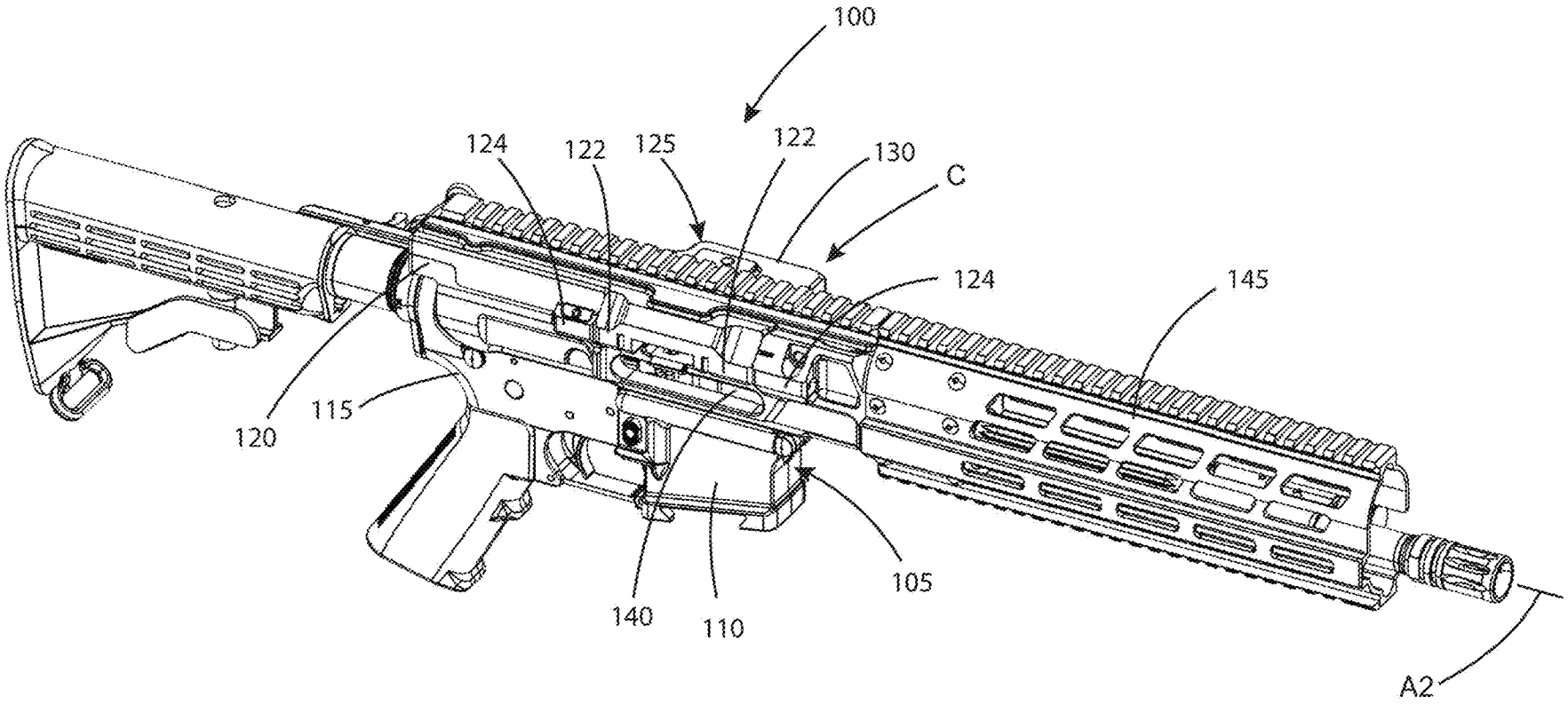
FIG. 2 is a second perspective view of the firearm shown in FIG. 1.
Figure 3:
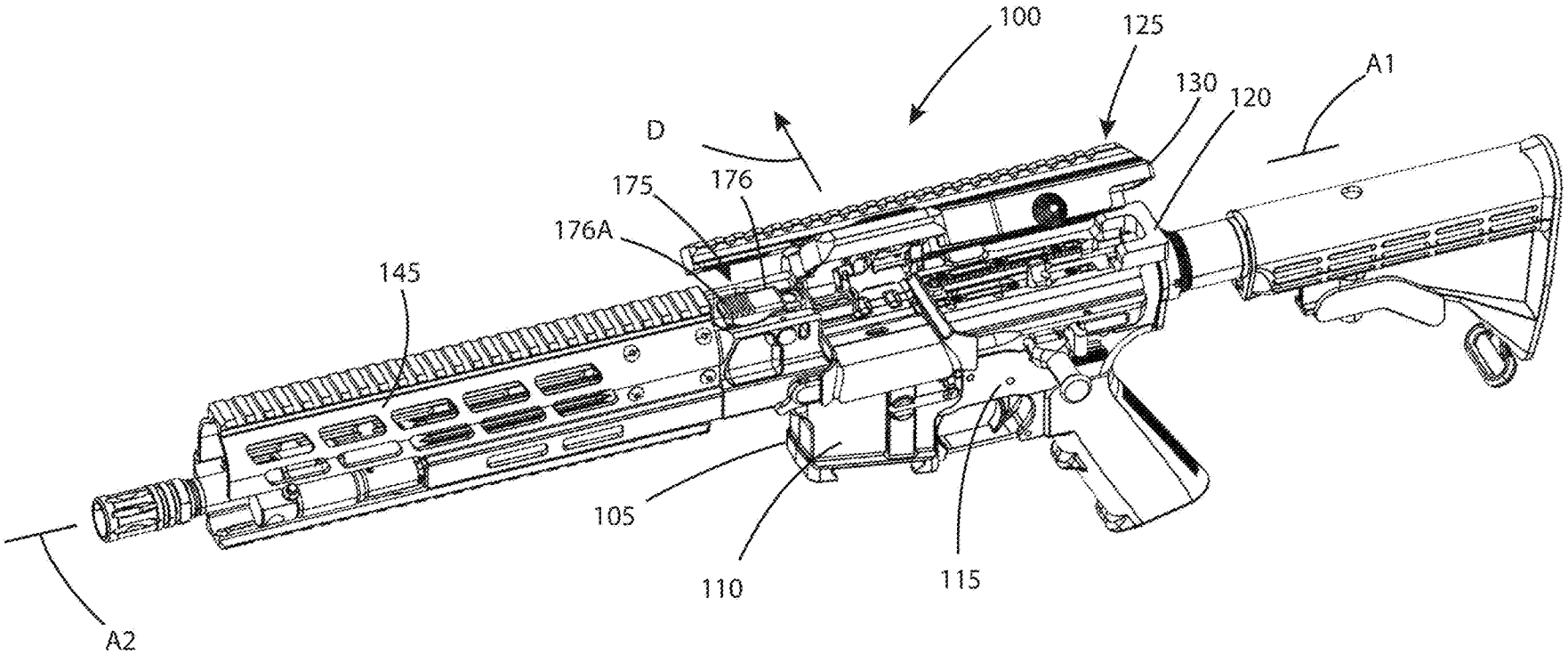
FIG. 3 is a third perspective view of the firearm shown in FIG. 1.

A firearm 100 in accordance with a first embodiment of the disclosures made herein is shown in FIGS. 1-3. A receiver system 105 of the firearm 100 includes a lower receiver body 115 (i.e., a receiver lower body portion) and an upper receiver body 120 (i.e., a receiver upper body portion) attached to the lower receiver body 115. The lower receiver body 115 and the upper receiver body 120 are an example of a split receiver system. In some embodiments, the lower receiver 115 may be characterized as being a body that includes at least one of a trigger and a magazine well. Receiver systems in accordance with embodiments of the disclosures made herein may have a single receiver. The firearm 100 may have a magazine well 110 for allowing ammunition to be supplied via a magazine engaged within the magazine well 110. It is disclosed herein that firearms in accordance with embodiments of the disclosures made herein are not limited to having any particular type of configuration of receiver assembly.

Preferably, but not necessarily, the firearm 100 may be configured for being operated in a semi-automatic mode, a fully-automatic mode, or selectively both modes known in the art as select-fire. The firearm 100 may be a rifle, carbine, light machine gun, medium machine gun, heavy machine gun, or the like. For example, the firearm 100 may be in the AR15 family of firearms, including M16 and M4 type firearms. Select-fire and fully-automatic modes of operation are well known in the art. For example, such modes of operation are described in detail in U.S. Pat. No. 6,634,274, which is incorporated herein in its entirety be reference.

Figure 4:
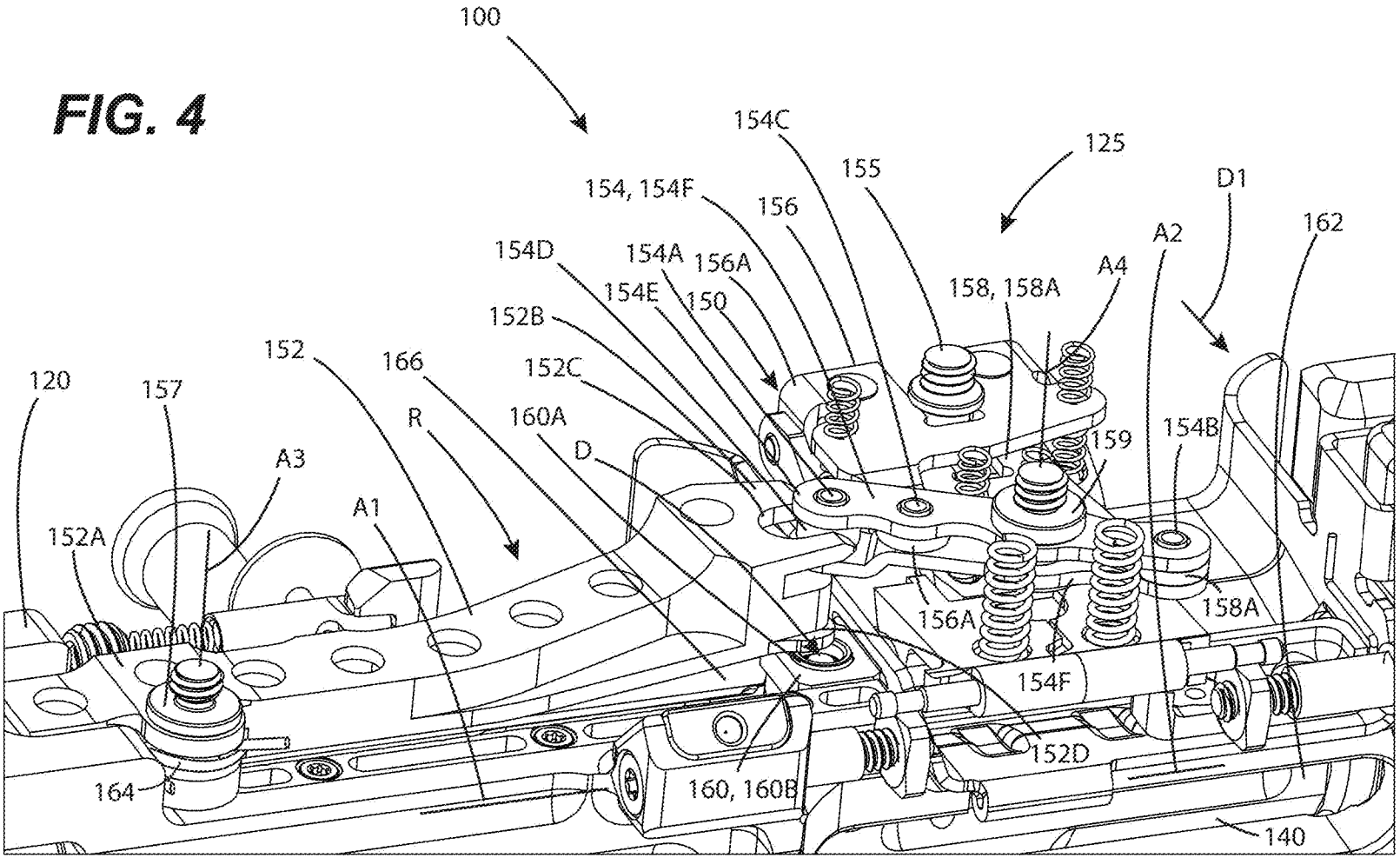
FIG. 4 is a first fragmentary view of the firearm of FIG. 1 showing an ammunition belt feeding apparatus of the firearm in FIG. 1 with the ammunition belt feeding apparatus in a closed position (ammunition belt feeding apparatus cover omitted).
Figure 5:
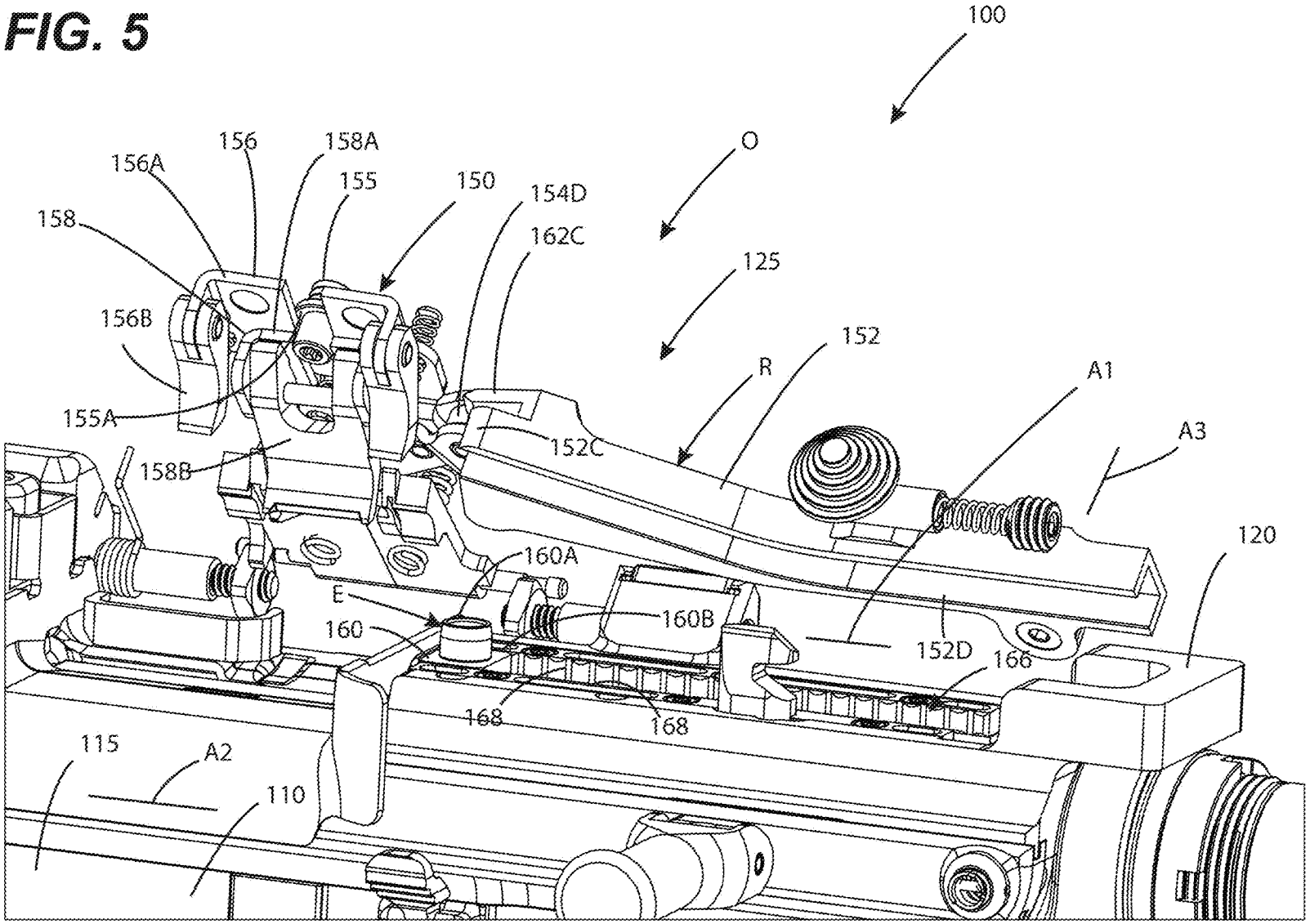
FIG. 5 is a second fragmentary view of the firearm of FIG. 1 showing the ammunition belt feeding apparatus of the firearm in FIG. 1 with the ammunition belt feeding apparatus in an open position (ammunition belt feeding apparatus cover omitted).
Figure 6:
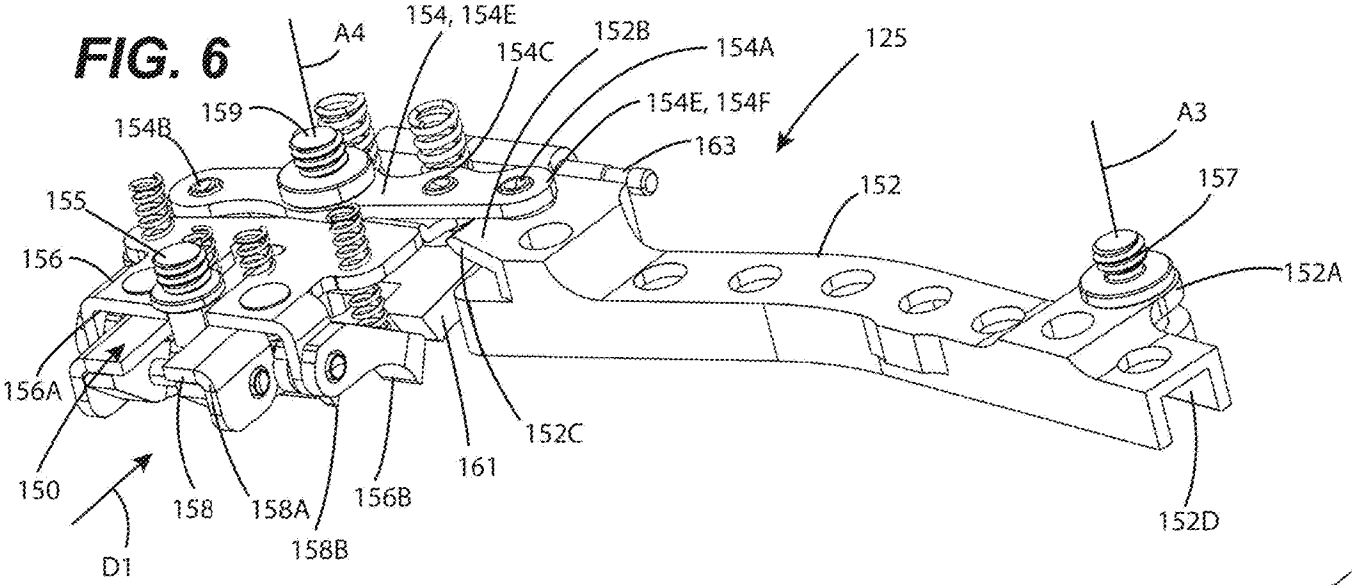
FIG. 6 is a first perspective view of the ammunition belt feeding apparatus of the firearm shown in FIG. 1 (ammunition belt feeding apparatus cover omitted).
Figure 7:
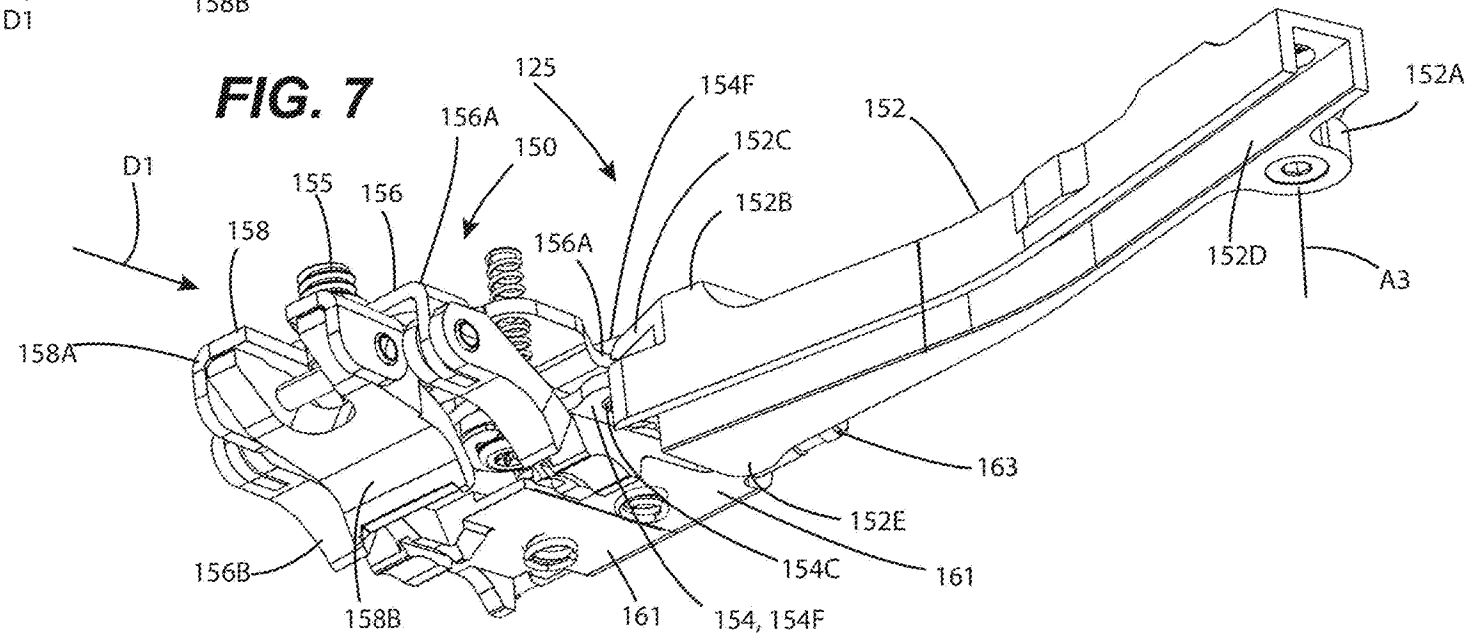
FIG. 7 is a second perspective view of the ammunition belt feeding apparatus of the firearm shown in FIG. 1 (ammunition belt feeding apparatus cover omitted).

Referring now to FIGS. 1-5, the firearm 100 includes an ammunition belt feeding apparatus 125 pivotably mounted on the upper receiver body 120. The ammunition belt feeding apparatus 125 and upper receiver body 120 jointly define a receiver assembly in accordance with a first embodiment of the disclosures made herein. The ammunition belt feeding apparatus 125 includes a top cover 130 that serves as a mounting frame for all other components of the ammunition belt feeding apparatus 125. The top cover 130 is pivotably engaged with the upper receiver body 120 via mounting bodies 122 of the top cover 130 that are each engaged with a mating mounting body 124 of the upper receiver body 120. The ammunition belt feeding apparatus 125 (including the top cover 130) is pivotable about a cover pivot axis A1 between a closed (battery-enabling) position C (FIGS. 1, 2, 4) and an open (ammunition belt loading) position O (FIGS. 3, 5). The top cover pivot axis A1 extends parallel to a centerline longitudinal axis A2 of a bolt carrier receiving bore 140 of the upper receiver body 120 (i.e., a centerline longitudinal axis of the firearm 100). It is disclosed herein that ammunition belt feeding apparatuses in accordance with embodiment of the disclosures made herein are not limited to a particular type or configuration of interface arrangement or mounting bodies for enabling a top cover thereof to be pivotably engaged with a receiver thereof. Preferably, a handguard 145 of the firearm 100 and the top cover 130 include accessory mounting structures such as, for example, Picatinny rails for allowing accessories to be selectively mounted on the handguard 145 and the top cover 130.

Beneficially, the cover pivot axis A1 extending parallel to a centerline longitudinal axis A2 of a bolt carrier receiving bore 140 of the upper receiver body 120 alleviates at least four drawbacks of conventional ammunition belt feeding apparatuses that have a cover pivot axis that extends perpendicular to a centerline longitudinal axis of a firearm. A first one of these drawbacks is colliding of serial-positioned accessories (e.g., optics devices) mounted respectively on the handguard 145 of the firearm 100 and the ammunition belt feeding apparatus cover 130 when the ammunition belt feeding apparatus cover 130 is moved from its closed position C toward its open position O for facilitating loading of an ammunition belt. Alleviating such colliding of serial-positioned accessories is beneficial from an overall firearm operability perspective. A second one of these drawbacks is excessive total opening height of the ammunition belt feeding apparatus cover required for installing a new ammunition belt. Alleviating such excessive total opening height of the ammunition belt feeding apparatus cover is beneficial from a shooter safety perspective (e.g., enabling the ability for a shooter and associated firearm to remain in a lower physical position during combat). A third one of these drawbacks is the restricted optics length permissible on legacy belt-fed firearms due to collision between the optics and handguards or barrels when opening the belt feed cover. A forth one of these drawbacks is overall cover instability due to the narrow practical length of the transverse axis pin on legacy belt-fed firearms. The present invention provides opportunity for a much longer axis pin for the belt-feed top cover, resulting in increased top cover stability and consequently, more accurate optical engagement of targets.

As best shown in FIGS. 4-7, which depict the ammunition belt feeding apparatus 125 with the top cover 130 omitted, all operational components of the ammunition belt feeding apparatus 125 are mounted on the top cover 130. The ammunition belt feeding apparatus 125 may include the top cover 130, an ammunition advancing mechanism 150, a feed lever 152, and a feed pawl yoke 154. The ammunition advancing mechanism 150 may be mounted on the top cover 130 via an ammunition advancing mechanism linear guide member 155 that is threadedly engaged with the top cover 130 and its engagement with the feed pawl yoke 154. The feed lever 152 may be mounted on the top cover 130 via a feed lever mounting member 157 that is threadedly engaged with the top cover 130 and that enables the feed lever 152 to be pivotable about a feed lever axis A3. The feed pawl yoke 154 may be mounted on the top cover 130 via a feed pawl yoke mounting member 159 that is threadedly engaged with the top cover 130 and that enables the feed pawl yoke 154 to be pivotable about a feed pawl yoke axis A4. In view of such mounting arrangement, the ammunition advancing mechanism 150, the feed lever 152, and the feed pawl yoke 154 move in concert with the top cover 130 as the top cover 130 is pivoted about the top cover pivot axis A1 between the closed position C and the open position O. Cartridge biasing bodies 161 are pivotably mounted on the top cover 130 via mounting member 163 which is engaged with mating portions of the top cover 130.

The ammunition advancing mechanism 150 is a shuttle feed ammunition advancing mechanism. Various configurations of shuttle feed ammunition advancing mechanisms are known in the art such as a single-step shuttle feed disclosed in U.S. Pat. No. 3,198,076. The detailed operation of a two-step shuttle feed ammunition advancing mechanism as may be used in embodiments of the present invention is disclosed in U.S. Pat. No. 6,634,274, which is incorporated herein in its entirety by reference. The ammunition advancing mechanism 150 may perform operationally for advancing an ammunition feed belt in the same manner as a prior art shuttle feed ammunition advancing mechanism. However, it is disclosed herein that implementations of ammunition advancing mechanism in accordance with embodiments of the disclosures made herein are not limited to having any particular type of configuration of structural arrangement so long as the intend ammunition belt feeding functionality is provided.

The ammunition advancing mechanism 150 includes an outer feed pawl assembly 156 and an inner feed pawl assembly 158. The outer feed pawl assembly 156 includes an outer pawl body mount 156A and an outer pawl bodies 156B pivotably attached to the outer pawl body mount 156A. The inner feed pawl assembly 158 includes an inner pawl body mount 158A and an inner pawl body 158B pivotably attached to the inner pawl body mount 158A. The outer pawl body mount 156A and the inner pawl body mount 158A are slidably engaged with the ammunition advancing mechanism mounting member 155 for enabling the outer pawl body mount 156A and the inner pawl body mount 158A to each move along a respective linear translation axis that extends parallel to an ammunition feeding direction D1.

The feed pawl yoke 154 is engaged with the feed pawl yoke mounting member 159 and with the feed pawl body mounts 156A and 158A at respective feed pawl body mount pivot points 154B, 154C. The feed pawl body mount pivot points 154B, 154C are located on opposing sides of the feed pawl yoke pivot axis A4 each with a respective pivot axis that extends parallel to the feed pawl yoke pivot axis A4. Accordingly, pivoting of the feed pawl yoke 154 about the feed pawl yoke pivot axis A4 results in movement of the feed pawl body mounts 156A and 158A in opposite direction of each other along the respective linear translation axis.

The feed lever 152 is pivotably engaged at its first end portion 152A with the feed lever mounting member 157. A second end portion 152B of the feed lever 152 includes a receptable 152C that is engaged with a first end portion 154E of the feed pawl yoke 154 via a feed lever engaging body 154D (e.g., a pin or roller). The feed lever engaging body 154D is rotatably mounted at pivot point 154A of the feed pawl yoke 154. A fork, pocket, groove, opening, channel, slot, or the like are examples of the receptable 152C, which enables required translation (e.g., rotational and linear) of the feed lever engaging body 154D with respect to the feed lever 152. Accordingly, pivoting the feed lever 152 about the feed lever pivot axis A3 causes a corresponding movement of the feed pawl yoke 154 about the feed pawl yoke pivot Axis A4 and such corresponding movement of the feed pawl yoke 154 causes a corresponding linear translation of the feed pawl body mounts 156A and 158A each along the respective linear translation axis. As can be best seen in FIGS. 4, 6, and 7, the feed pawl yoke 154 comprises spaced-apart yoke plates 154F, pin members located at the feed pawl yoke pivot points 154A, 154B, 154C, and the feed lever engaging body 154D.

Referring now to FIGS. 4 and 5, the ammunition belt feeding apparatus 125 possesses a reset mode that is implemented in response to the top cover 130 being moved from the closed position C (FIG. 4) to the open position O (FIG. 5). To this end, as the top cover 130 is being moved from the closed position C to the open position O, a feed stud 160A of a feed stud assembly 160 becomes disengaged from within a feed lever channel 152D of the feed lever 152. The feed stud 160A is mounted on a feed stud housing 160B that is fixedly attached to a bolt carrier 162 slidably disposed within a bolt carrier receiving bore 140 of the upper receiver body 120. Movement of the ammunition advancing mechanism 150 is governed by a profile of the feed lever channel 152D, which may include one or more dwell segments where movement of the feed stud 160A within such dwell segments results in no corresponding movement of the feed pawl assemblies 156, 158 and may include one or more active segments where movement of the feed stud 160A within such active segments results in corresponding movement of the feed pawl assemblies 156, 158.

The reset mode enables proper operational alignment of a newly installed ammunition feed belt with the feed pawl assemblies 156, 158 of the ammunition advancing mechanism 150 and the bolt carrier 162. To this end, feed lever 152 is spring biased via spring 164 to a reset position R (FIGS. 4 and 5) in which the feed lever 152 is brought to full rotation in a counter-clockwise rotational direction thereby causing the feed pawl bodies 156 and 158 to move to corresponding reset positions. The feed stud 160A is mounted on the feed stud housing 160B to be movable between an extended position E relative to an upper surface of the feed stud housing 160B and a depressed position D relative to the upper surface of the feed stud housing 160B. The feed stud 160A is spring-biased to the extended position E.

As best shown in FIG. 5, the feed stud housing 160B is disposed within a feed stud housing channel 166 of the upper receiver body 120. To manage movement control, friction, and wear considerations as related to movement of the feed stud housing 160B within the feed stud housing channel 166, guide bodies 168 are attached to the upper receiver body 120 at opposing sides of the feed stud housing channel 166. Feed stud housing engaging surfaces of each guide bodies 168 may have a plurality of friction-reducing discontinuities formed therein, which also provide relief cavities to displace foreign contaminants such as dust, sand, dirt, mud, ice or the like. For example, adjacent protrusions may jointly form individual friction-reducing discontinuities therebetween. Alternatively or additionally, the guide bodies 168 may be made from a friction-reducing material.

When the feed lever 152 is in the reset position R, the bolt carrier 162 may be in the battery-ready (i.e., forward-most) position. As such, the feed stud 160A is in its corresponding forward-most position when the bolt carrier 162 is in its battery-ready position. However, upon closing the top cover 130, the feed lever channel 152D is mis-aligned from the feed stud 160A because the feed lever has been rotated to the reset position R. To accommodate these apparatus conditions, the feed stud 160A becomes moved to and retained in the depressed position D by a feed stud depressing portion 152E of the feed lever 152 when the feed lever 152 is in the reset position R and the top cover 130 is in the closed position C. As the bolt carrier 162 is moved from its battery-ready position to a rearward position for chambering a round of ammunition, the feed stud 160A realigns with the feed lever channel 152D such that it is spring-biased into engagement within the dwell segment of the feed lever channel 152D and urges the feed lever 152 to its ready position as the bolt carrier 162 returns to the battery-ready position. The feed stud 160A being engaged within the feed stud channel 152D enables the ammunition advancing mechanism 150 to move in unison with the feed lever 152 as defined by the profile of the feed stud channel 152D while the bolt carrier 162 moves between the battery-enabling position and rearward (e.g., recoil) position.

Figure 8:
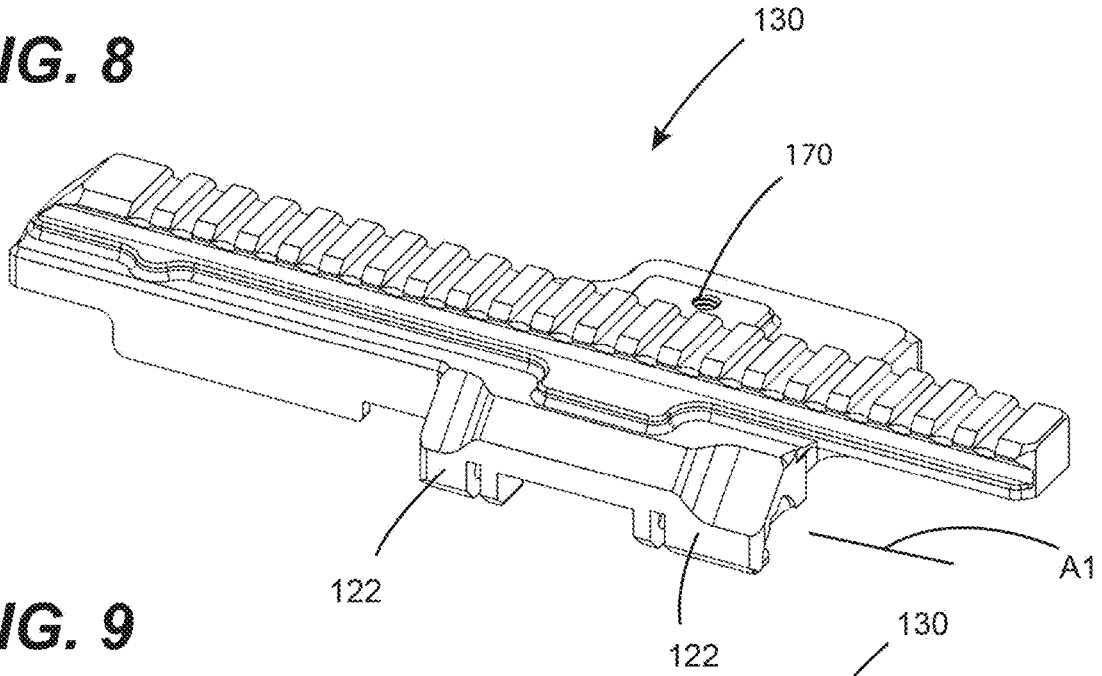
FIG. 8 is a first perspective view of the ammunition belt feeding apparatus cover shown in FIG. 1.
Figure 9:
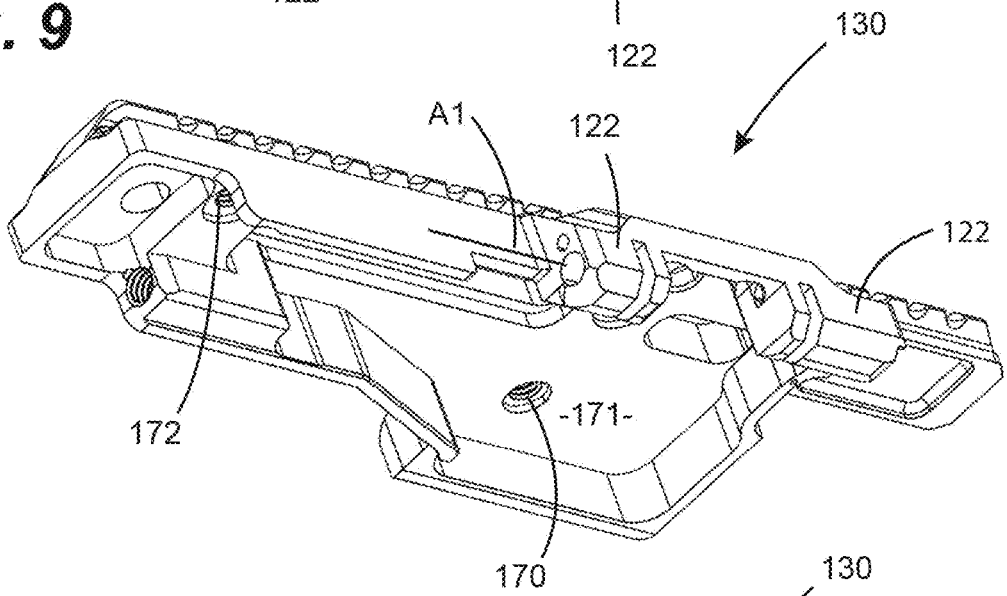
FIG. 9 is a second perspective view of the ammunition belt feeding apparatus cover shown in FIG. 1.
Figure 10:
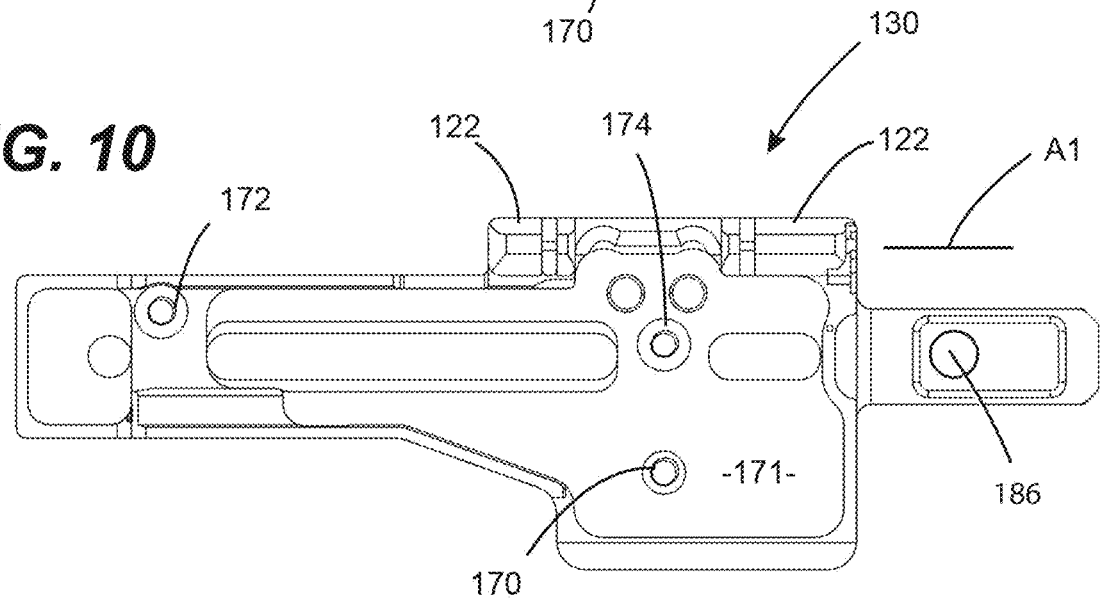
FIG. 10 is a bottom view of the ammunition belt feeding apparatus cover shown in FIG. 1.

Referring now to FIGS. 8-10, the top cover 130 may be unitarily formed from a single piece of material or may be formed as a single piece of material. To this end, the top cover may be, for example, molded, cast, 3D printed, or machined. The top cover 130 includes a first mounting portion 170 (e.g., threaded hole or boss) adapted for having the ammunition advancing mechanism linear guide member 155 threadedly engaged therewith (i.e., defining an ammunition advancing mechanism mounting surface 171 of the top cover 130), a second mounting portion 172 adapted for having the ammunition advancing mechanism linear guide member 155 threadedly engaged therewith, and a third mounting portion 174 adapted for having the feed pawl yoke mounting member 159 threadedly engaged therewith. In preferred embodiments, the ammunition advancing mechanism mounting surface 171 extends parallel to a mounting surface 155A of the ammunition advancing mechanism linear guide member 155. The mounting bodies 122 of the top cover 130 are each engaged with a mating mounting body 124 of the upper receiver body 120, as shown in FIG. 2, for enabling the top cover to be pivotable about the cover pivot axis A1 between the closed position C (FIGS. 1, 2, 4) and the open position O (FIGS. 3, 5).

Figure 11:
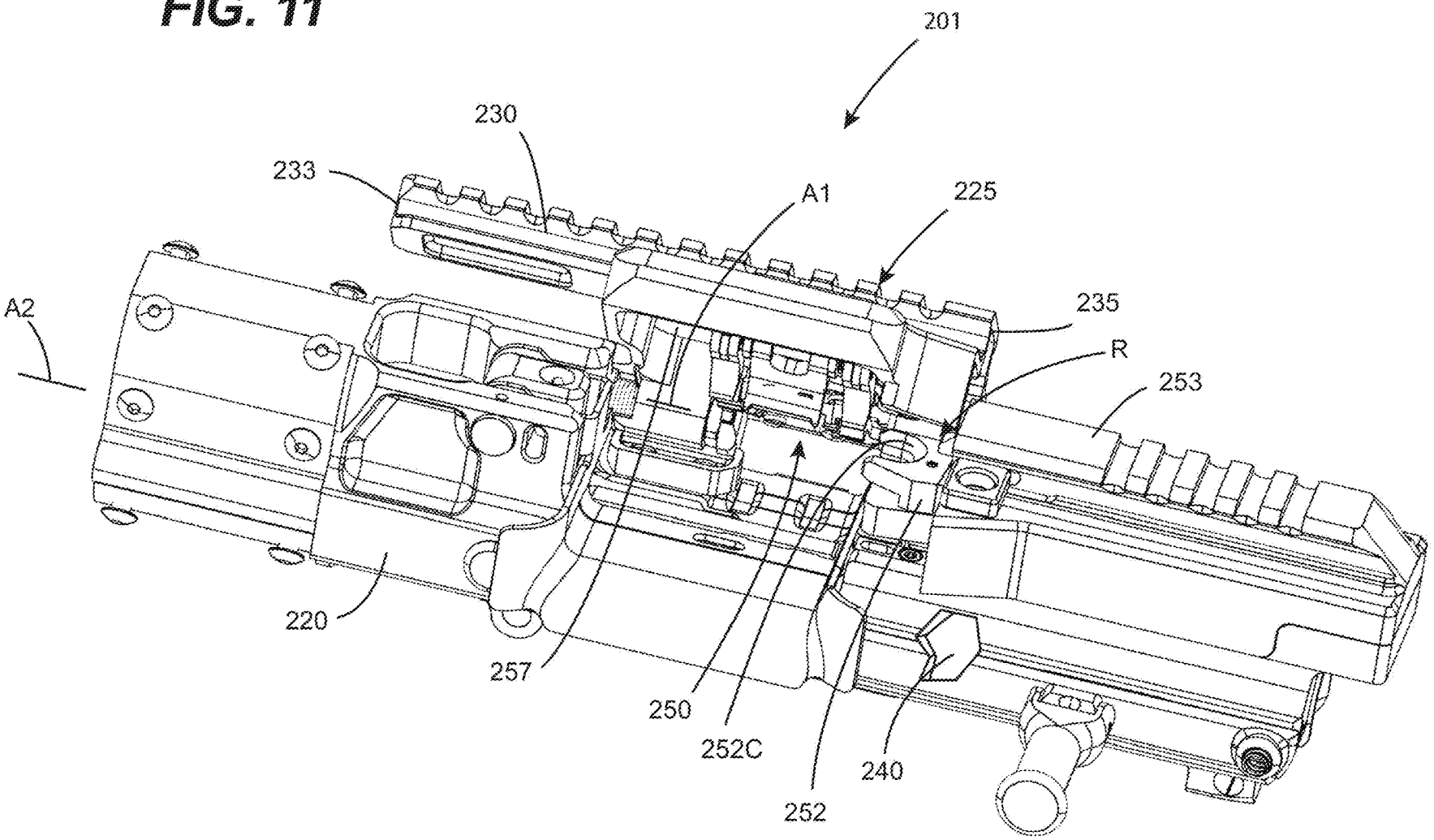
FIG. 11 is a perspective view of a receiver assembly having an ammunition belt feeding apparatus with a split cover arrangement.
Figure 12:
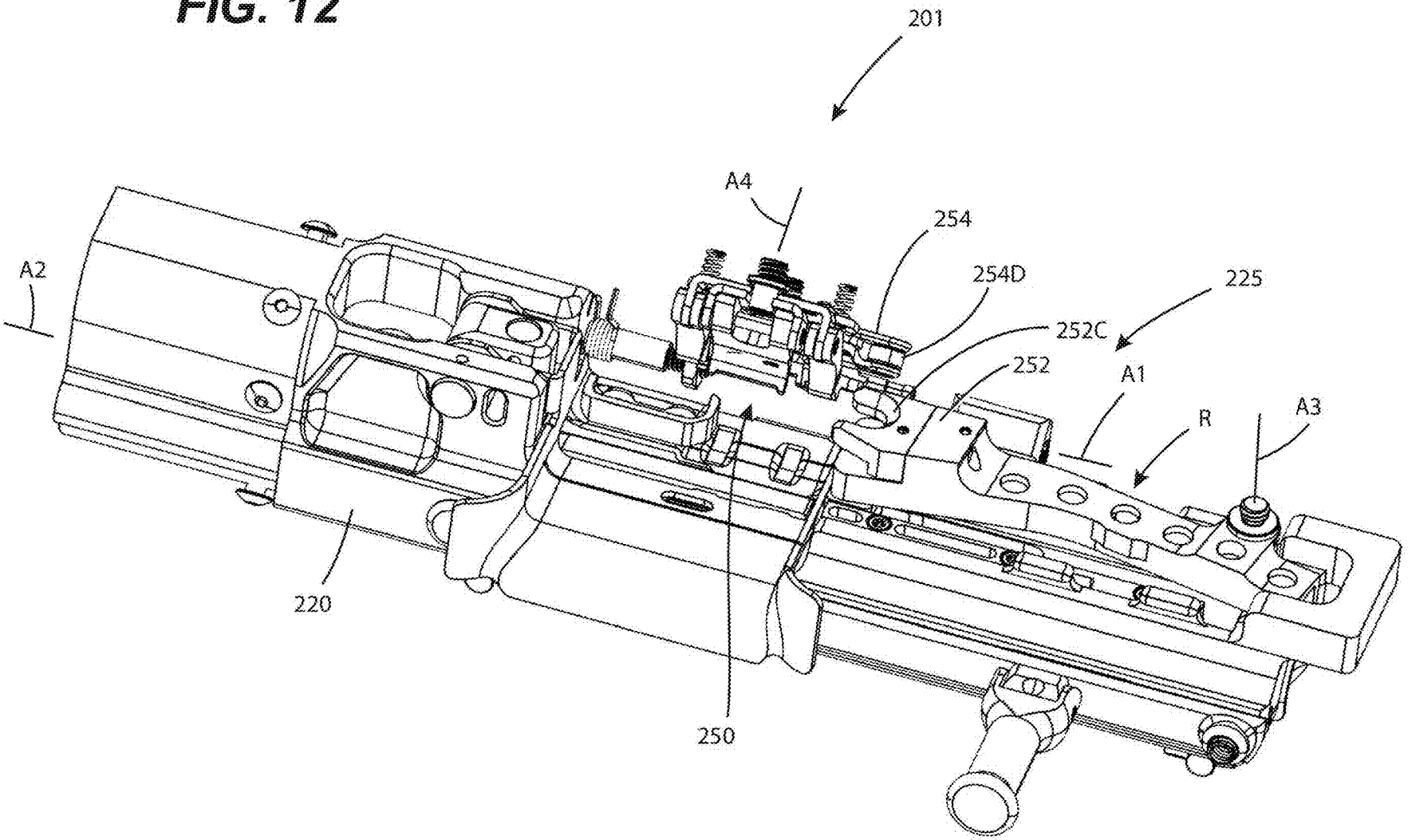
FIG. 12 is a perspective view of the receiver assembly shown in FIG. 11 with fixed and movable ammunition belt feeding apparatus covers omitted.

Referring now to FIGS. 11 and 12, a receiver assembly 201 in accordance with a second embodiment of the disclosures made herein has a split feed cover arrangement. The underlying structure and operability of the receiver assembly 201 is essentially the same as that of the receiver assembly disclosed above in reference to FIGS. 1-10. The primary difference in the two embodiments is that the receiver assembly 200 in accordance with a second embodiment includes a feed lever 252 that is pivotably mounted on a receiver body 220 as opposed to an ammunition belt feeding apparatus (i.e., the top cover thereof).

The feed lever 252 is located under a fixed position top cover 231 that is engaged in a fixed manner with the receiver body 220, whereas the ammunition advancing mechanism 250 and the feed pawl yoke 254 are mounted on a movable top cover 230 that is pivotably attached to receiver body 220 to pivot about a top cover pivot axis A1 that extends parallel to a centerline longitudinal axis A2 of a bolt carrier receiving bore 240 of the receiver body 220. A feed pawl yoke pivot axis A4 of the feed pawl yoke 254 extends perpendicularly to a feed pawl movement direction and a plane defined by an ammunition advancing mechanism mounting surface 257 of the movable top cover 230. Notably, the feed lever pivot axis A3 extends in a fixed direction relative to the centerline longitudinal axis A2 of the bolt carrier receiving bore of the receiver body 220 and to the top cover pivot axis A1 even as the moveable top cover 230 is pivoted between a closed (battery-enabling) position and an open (ammunition belt loading) position.

The ammunition advancing mechanism 250, the movable top cover 230, the feed lever 252, and the feed pawl yoke 254 jointly define the ammunition belt feeding apparatus 225. Operation and arrangement of the ammunition advancing mechanism 250, movable top cover 230, and the feed pawl yoke 254 may be the same or effectively similar to that of the ammunition belt feeding apparatus 125 discussed above in reference to FIGS. 1-10. Advantageously, by virtue of the feed lever 252 being pivotably mounted on the receiver body 220, fewer components of the ammunition belt feeding apparatus are attached to the moveable top cover 230. Additionally, such a split feed cover arrangement allows serially-mounted accessories (e.g., optics devices) to be mounted across a front end face 233 of the movable top cover 230 and/or a rear end face 235 of the movable top cover 230

To accommodate operable engagement of the feed lever 252 and the feed pawl yoke 254, the feed pawl yoke 254 includes a feed lever engaging body 254D (e.g., a pin or roller) at its first end portion thereof and the feed lever 252 includes a receptacle 252C at its second end portion. A fork, pocket, groove, opening, channel, slot, or the like are examples of the receptacle 252C, which enables rotational and linear translation of the feed lever engaging body 254D with respect to the feed lever 252. The feed lever engaging body 254D, the associated first end portion of the feed pawl yoke 254, and the receptacle 252C are jointly configured for enabling the feed lever engaging body 254D to become disengaged from and engaged with the receptacle 252C when the movable top cover 230 is pivoted (i.e., moved) between the closed and open position, respectively. For example, the receptacle 252C may have a beveled top edge or be partially/fully tapered to permit the feed lever engaging body 254D to enter the receptacle 252C in an off-axis (e.g., angled) manner and the lower portion of the feed pawl yoke 254 at its first end portion may be configured for enabling the feed lever engaging body 254D and first end portion of the feed pawl yoke 254 (e.g., a bottom plate thereof) to physically move into and out of engagement with the receptacle 252C.

Figure 13:
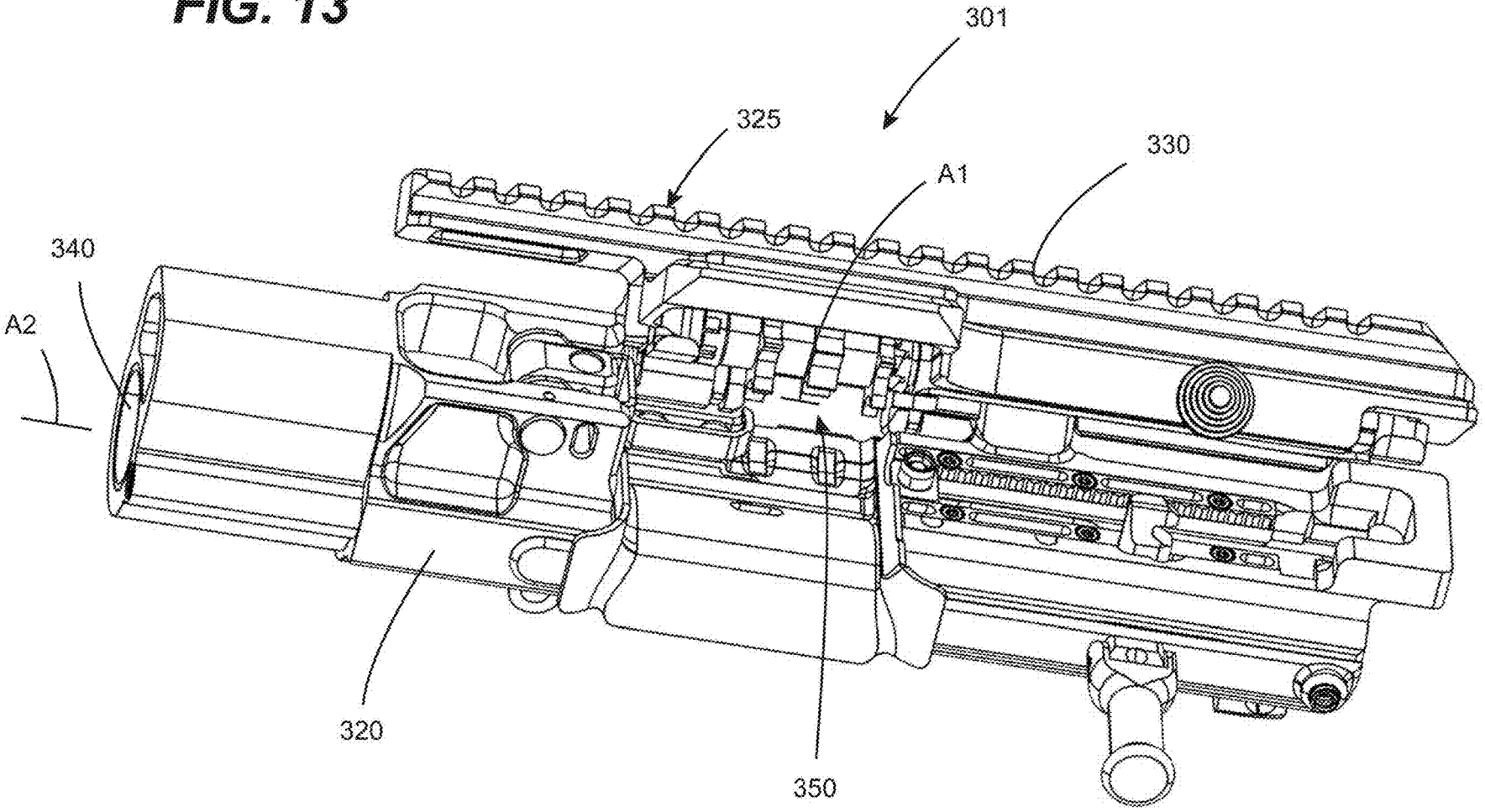
FIG. 13 is a perspective view of a receiver assembly having a sprocket feed type ammunition belt feeding apparatus.
Figure 14:
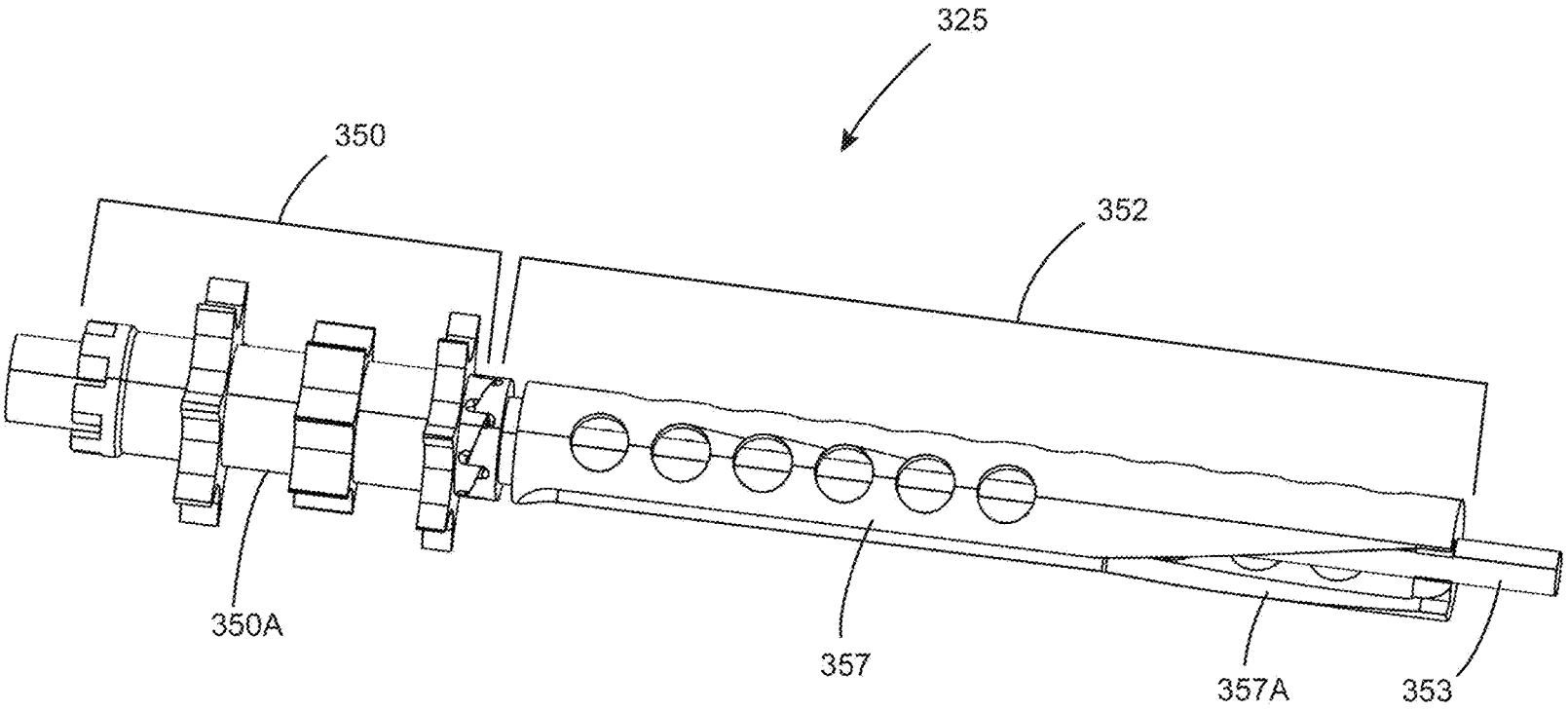
FIG. 14 is a perspective view of the sprocket feed type ammunition belt feeding apparatus in FIG. 13.

Referring now to FIGS. 13 and 14, a receiver assembly 301 in accordance with a third embodiment of the disclosures made herein has a sprocket-type ammunition belt feeding apparatus (i.e., ammunition belt feeding apparatus 325) pivotably mounted on a receiver body 320 (e.g., an upper receiver). The ammunition belt feeding apparatus 325 includes a top cover 330, a sprocket feed ammunition advancing mechanism (i.e., ammunition advancing mechanism 350), and a drive shaft assembly 352. The top cover 330 is pivotably mounted on the receiver body 320 for enabling the top cover 330 to pivot about a cover pivot axis A1 between a closed (battery-enabling) position and an open (ammunition belt loading) position. The top cover pivot axis A1 extends parallel to a centerline longitudinal axis A2 of a bolt carrier receiving bore 340 of the receiver body 320. The drive shaft assembly 352 may be rotatably mounted on the top cover 330 such as via a mounting shaft 353. A drive shaft 357 of the drive shaft assembly 352 includes a drive slot 357A that receives a feed pin fixedly engaged with a bolt carrier slidably mounted within the bolt carrier receiving bore 340, as discussed above in reference to FIGS. 5 and 7). A shape of the drive slot 357A mandates rotational movement of the drive shaft 357 as the bolt carrier moves longitudinally along the bolt carrier receiving bore 340. Sprocket-type ammunition belt feeding apparatuses are well known in the art. For example, the detailed operation of such a sprocket-type ammunition belt feeding apparatus is disclosed in U.S. Pat. No. 6,634,274, which is incorporated herein in its entirety by reference.

Figure 15:
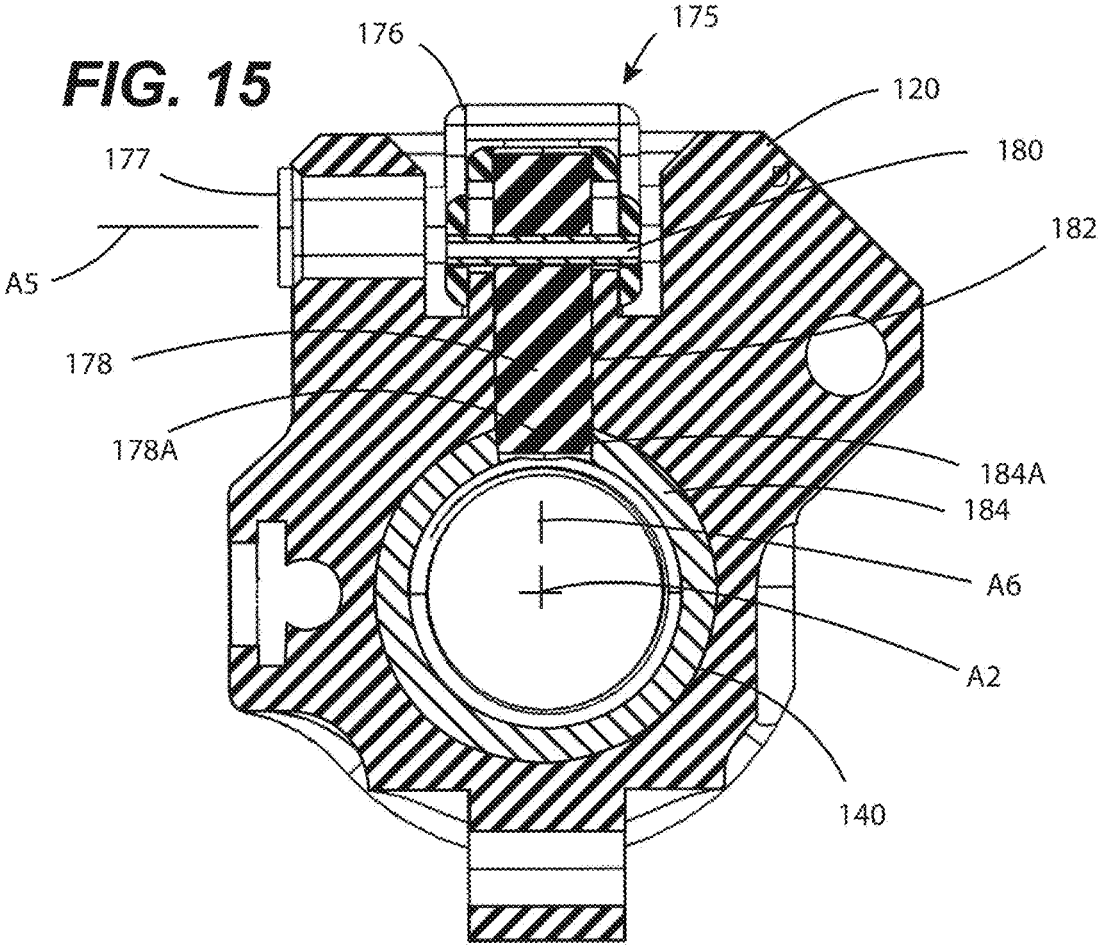
FIG. 15 is a cross sectional view of the rifle 100 shown in FIGS. 1-5 in partial build configuration, showing components of a barrel retention mechanism in accordance with embodiments of the disclosures made herein.
Figure 16:
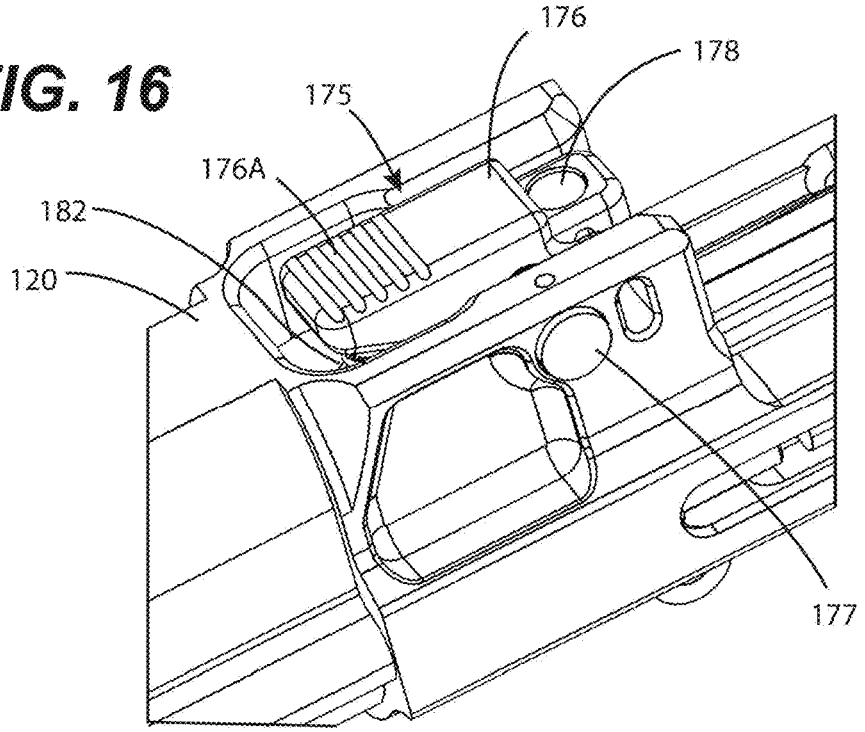
FIG. 16 is a fragmentary view of the rifle 100 shown in FIGS. 1-5 in partial build configuration, showing components of a barrel retention mechanism in accordance with embodiments of the disclosures made herein.

Referring to FIGS. 3, 15, and 16, aspects of a barrel retention mechanism 175 in accordance with embodiments of the disclosures made herein are shown. The barrel retention mechanism 175 includes a latch body 176, a mounting pin 177, a barrel retention member 178, a coupling pin 180, and a biasing spring 182. The latch body 176 is pivotably mounted on the upper receiver body 120 via the mounting pin 177. The mounting pin 177 (i.e., a mounting member) extends through a mating pin bore of the upper receiver body 120 and the latch body 176 for enabling the latch body 176 to pivot about a pivot axis extending through the mounting pin 177. The barrel retention member 178 (e.g., a pin that has a round cross-section) is slidably engaged within a barrel retention member bore 182 that may extend through (preferably vertically) the centerline longitudinal axis A2 of the bolt carrier receiving bore 140.

A distal end portion 178A of the barrel retention member 178 (preferably tapered) engages a mating receptacle 184A of a barrel extension 184 disposed within the bolt carrier receiving bore 140 for securing the barrel extension 184 in fixed engagement with the upper receiver body 120. The barrel extension 184 and mated barrel jointly define a barrel assembly. The barrel retention member 178 is engaged with the latch body 176 via the coupling pin 180 (i.e., a coupling member). Rotational movement of the latch body 176 about a latch pivot axis A5 between a locking position (shown) and a displaced position (not shown—actuation portion 176A of the latch body 176 depressed) causes a corresponding axial movement of the barrel retention member 178 within the barrel retention member bore 172 between a barrel securing position (shown) and a retracted position (not shown—barrel retention member 178 extracted from within the receptacle 184A of the barrel extension 184).

In use, an actuation portion 176A of the latch body 176 may be depressed for causing the latch body 176 to move from the locking position to the displaced position to thereby cause the barrel retention pin 178 to move axially along a centerline axis A6 of the barrel retention pin bore 182 from the locking position to the retracted position. With the barrel retention member 178 in the retracted position, the barrel retention member 178 is sufficiently displaced from within the mating receptacle 184A for enabling the barrel extension 184 (and thus an attached barrel) to be detached from the upper receiver body 120.

Advantageously, the barrel retention mechanism 175 and the top cover 130 are jointly configured for inhibiting the latch body 176 from moving from the locking position to (or toward) the displaced position when the top cover 130 is in the closed position C (FIGS. 1 and 2). For example, a clearance between the top cover 130 and the latch body 176 and/or the barrel retention member 178 (e.g., at structural element 186 of the top cover 130 in FIG. 10) with the top cover in the closed position C may be less than a clearance necessary for the latch body 176 to pivot sufficiently for enabling the barrel retention member 178 to move from the barrel locking position to the retracted position. Thus, the latch body 176 being under the top cover 130 protects against accidental release of the barrel extension 184 from the upper receiver body 120 as a result of physical depression of the degression of the latch body 176 when the top cover 130 is in the closed position C. Similarly, inhibiting the latch body 176 from being otherwise able to move from the barrel locking position to the displaced position when the top cover 130 is in the closed position C protects against unintended separation of the barrel retention member 178 from the mating receptacle 184A of the barrel extension 184. In some embodiments, the top cover 130 may include or be an accessory rail. The top cover 130 may conceal and/or prevent operational access to, and/or prevent physical access of all or a portion of the latch body 176 when in the closed position C.

Figure 17:
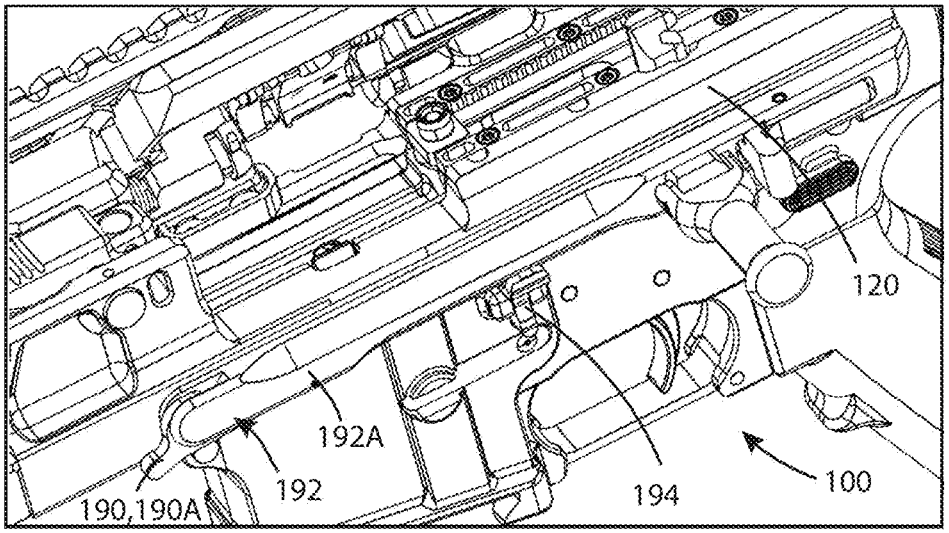
FIG. 17 is a fragmentary view of the rifle 100 shown in FIGS. 1-5, showing a charging handle assembly including a bolt catch activating device in accordance with embodiments of the disclosures made herein, where the charging handle assembly and bolt catch are in respective battery-enabling positions.
Figure 18:
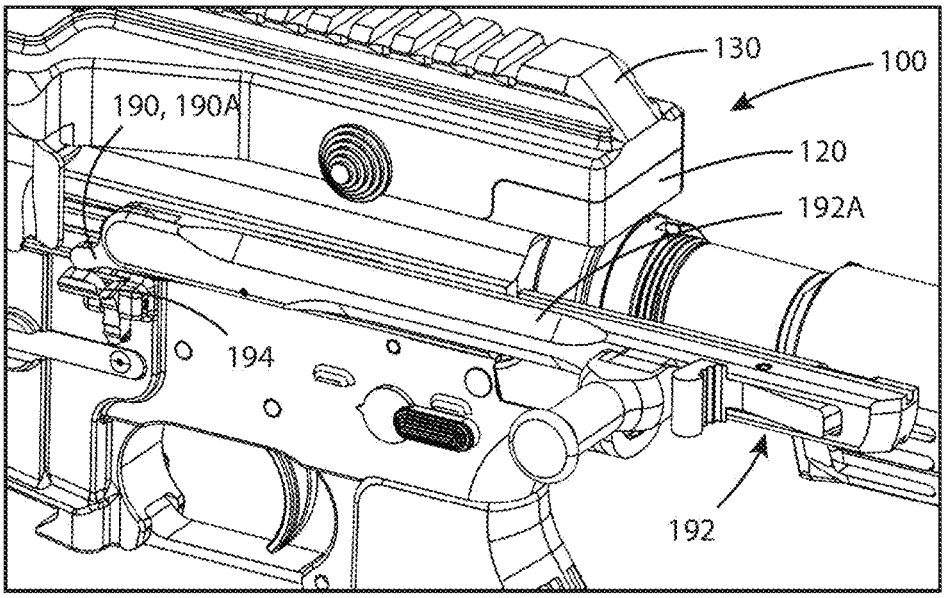
FIG. 18 is a fragmentary view of the rifle 100 showing the charging handle assembly in a bolt retracting position and the bolt catch moved to a bolt engaging position by engagement with the bolt catch activating device.
Figure 19:
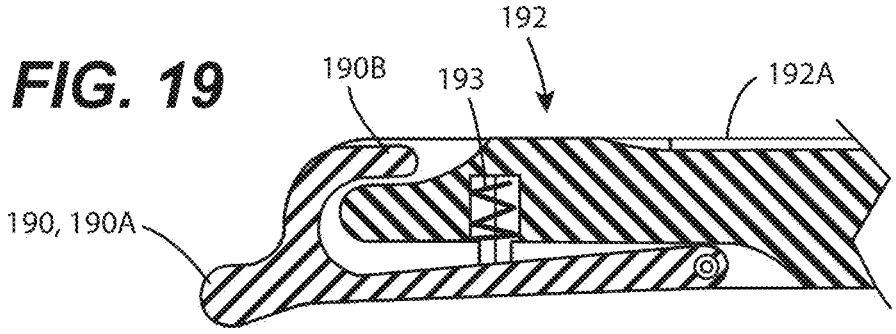
FIG. 19 is a fragmentary cross-sectional view showing the bolt catch activating device.

Referring now to FIGS. 17-19, a bolt catch activating device 190 in accordance with embodiments of the disclosures made herein is integral with a charging handle assembly 192. The bolt catch activating device 190 may be movably (e.g., pivotably) attached to a main body 192A of the charging handle assembly 192. The main body 192A of the charging handle assembly 192 is mounted on the upper receiver body 120 for being movable (slidable) between a battery-enabling position (FIG. 17) and a fully-displaced position (FIG. 18).

The bolt catch activating device 190 may include a structural element 190B that engages a mating portion of the main body 192A of the charging handle assembly 192 to limit and/or control position and/or displacement of the bolt catch activating device 190 relative to the main body 192A of the charging handle assembly 192. The bolt catch activating device 190 may be biased (e.g., by spring 193) or otherwise to be maintaining in an at-rest position (FIGS. 17 and 19) and to be capable of being urged to a displaced position (FIG. 18) relative to the main body 192A of the charging handle assembly 192. In some embodiments, the bolt catch activating device 190 may be fixedly attached to or be a unitarily-formed component of the main body 192A of the charging handle assembly 192 to exhibit minimal or negligible movement relative to the main body 192A of the charging handle assembly 192.

A bolt catch 194 is moveably mounted on the lower receiver body 115 for being movable between a disengaged position (FIG. 18) and a bolt-engaging position (FIG. 19). As is well known in the art, when the bolt catch 194 is in the bolt engaging position, a bolt (or other component of a bolt carrier group) of the firearm 100 may become engaged with the bolt catch 194 for retaining the bolt carrier group (or other type of breech control apparatus) in a retracted position (i.e., displaced rearward away from its battery-enabling position) until the bolt catch 194 is moved back to its disengaged position.

Advantageously, bolt catch activating devices in accordance with embodiments of the disclosures made herein (e.g., the bolt catch activating device 190) allow a shooter to selectively secure the bolt carrier group in a retracted position away from its battery-enabling position after discharging rounds of ammunition to limit or eliminate the potential for a chambered round of ammunition to "cook-off". In use, when the main body 192A of the charging handle assembly 192 is moved from its battery-enabling position toward its fully-displaced position, a currently chambered round of ammunition is ejected. Further movement of the charging handle assembly 192 toward its fully-displaced position causes an engagement member 190A of the bolt catch activating device 190 to become engaged with and to move the bolt catch 194 from its disengaged position to its bolt-engaging position. Thereafter, forward movement of the charging handle assembly 192 causes the bolt carrier group to become engaged by the bolt catch 194 whereby the bolt carrier group is retained in a rearwardly displaced position with respect to its battery-enabling position. In this manner, the breech of the rifle is cleared of any round of ammunition and the bolt carrier group is better positioned to liberate retained heat. If the shooter desires to continue firing the weapon while the bolt carrier group is retained in a rearwardly displaced position by the bolt catch 194, the shooter will depresses the upper portion of the bolt catch member 194 causing the bolt carrier engaging surface of the bolt catch 194 to become separated from the bolt carrier group, and consequently causing the bolt carrier group to be automatically returned to the battery-enabling position by the urging of the compressed recoil (main action) spring, whereupon the trigger can be depressed to immediately initiate the firing sequence.

Figure 20:
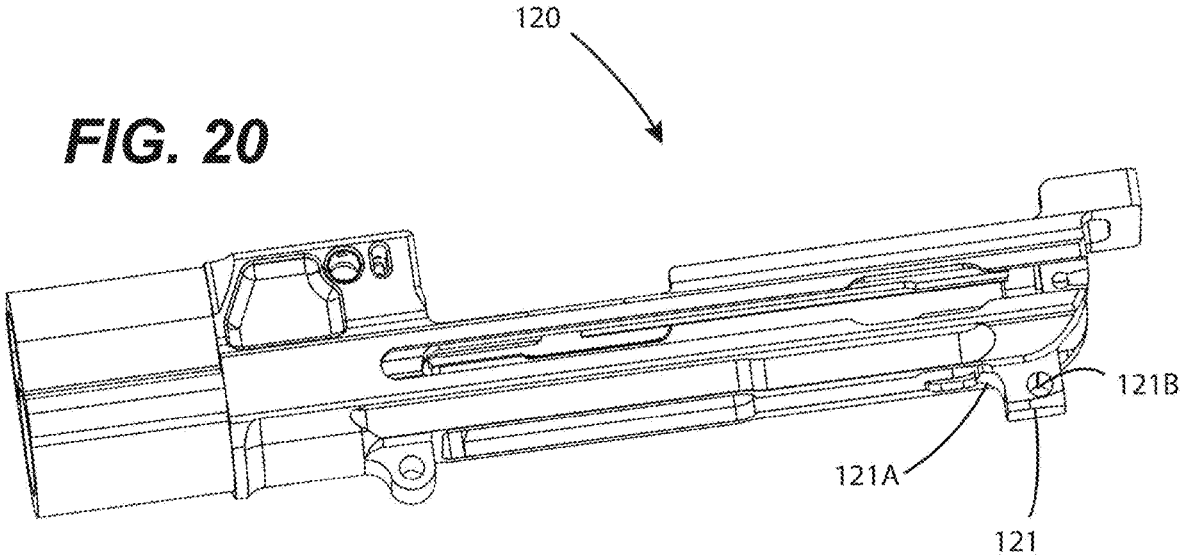
FIG. 20 is a perspective view of the upper receiver body shown in FIG. 1 with an enhanced length rear lug in accordance with embodiments of the disclosures made herein.
Figure 21:
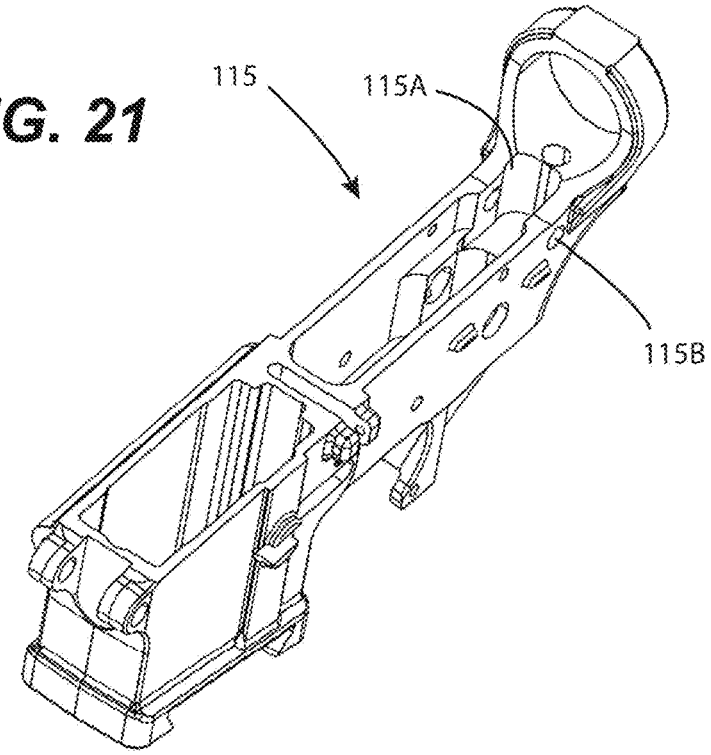
FIG. 21 is a perspective view of the lower receiver body shown in FIG. 1 which is compatible with the rear lug configuration of the upper receiver body of FIG. 20.

Turning now to FIGS. 20 and 21, a rear lug 121 of the upper receiver body 120 includes a fillet 121A at least at a forward portion thereof. The fillet 121A provides for an increase in strength (e.g., tensile, shear, fatigue, or a combination thereof) between the rear lug 121 and an engaged portion of the upper receiver body 120. The fillet 121A is one example of implementation of the inclusion of strengthening material that may be retained during machining of the upper receiver body 120.

As shown, a length of the rear lug 121 may be longer than at least prior art rear lugs of AR15, M16, and M4 upper receivers. For example, a length of the rear lug 121 may be at least about 0.10 " longer than a rear lug of a prior art AR15, M16, and M4 upper receiver body. Advantageously, lengthening of the rear lug 121 may be provided for by additional material at a forward portion of the rear lug 121 and a take-down pin passage 121B of the rear lug 121 may be positioned to reside at least partially in a region of material of the rear lug 121 provided for by such lengthening of the rear lug 121. For example, the rear lug 121 may be about 0.60 " long and the take-down pin passage 121B may be closer to a rear edge of the rear lug 121 than it is to a front edge of the rear lug 121. To accommodate such lengthening of the rear lug 121 and rearward placement of the take-down pin passage 121B, a rear lug receiving well 115A of the lower receiver 115 accommodates the forward direction lengthening of the rear lug 121. Jointly, the enhanced length of the rear lug 121 and the rearward position of the take-down pin passage 121B of the rear lug 121 beneficially promote increased robustness of the rear lug interface.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm receiver assembly, comprising:

a receiver body;

an ammunition advancing mechanism operable to advance an ammunition feed belt along an ammunition feeding direction, wherein the ammunition advancing mechanism is a shuttle feed ammunition advancing mechanism;

a top cover including at least one mounting body and having the ammunition advancing mechanism mounted thereon, wherein the at least one mounting body enables the top cover to be pivotably attached to a mating interface portion of the receiver body, wherein the at least one mounting body defines a top cover pivot axis, wherein the top cover is pivotable about the top cover pivot axis, and wherein the top cover pivot axis extends perpendicularly to the ammunition feeding direction;

a feed lever; and a feed pawl yoke, wherein the feed pawl yoke is pivotably mounted on the top cover, wherein the feed lever is movably engaged with the feed pawl yoke whereby pivotal movement of the feed lever about a pivot axis thereof causes a corresponding pivotal movement of the feed pawl yoke about a pivot axis thereof and wherein the feed pawl yoke is movably engaged with the ammunition advancing mechanism whereby said corresponding pivotal movement of the feed lever about the pivot axis thereof causes a corresponding linear movement of feed pawl bodies of the ammunition advancing mechanism.

2. A firearm receiver assembly, comprising:

a receiver body;

an ammunition advancing mechanism operable to advance an ammunition feed belt along an ammunition feeding direction, wherein the ammunition advancing mechanism is a shuttle feed ammunition advancing mechanism;

a top cover including at least one mounting body and having the ammunition advancing mechanism mounted thereon, wherein the at least one mounting body enables the top cover to be pivotably attached to a mating interface portion of the receiver body, wherein the at least one mounting body defines a top cover pivot axis, wherein the top cover is pivotable about the top cover pivot axis, and wherein the top cover pivot axis extends perpendicularly to the ammunition feeding direction;

a feed pawl yoke pivotably mounted on the top cover to pivot about a feed pawl yoke pivot axis extending perpendicular to an ammunition advancing mechanism mounting surface of the top cover; and a feed lever pivotable about a feed lever pivot axis extending in a fixed direction relative to the top cover pivot axis whereby the feed lever pivot axis remains in a fixed orientation relative to the top cover pivot axis as the top cover is pivoted about the top cover pivot axis.

3. A firearm receiver assembly, comprising:

a receiver body;

an ammunition advancing mechanism operable to advance an ammunition feed belt along an ammunition feeding direction, wherein the ammunition advancing mechanism is a shuttle feed ammunition advancing mechanism;

a top cover including at least one mounting body and having the ammunition advancing mechanism mounted thereon, wherein the at least one mounting body enables the top cover to be pivotably attached to a mating interface portion of the receiver body, wherein the at least one mounting body defines a top cover pivot axis, wherein the top cover is pivotable about the top cover pivot axis, and wherein the top cover pivot axis extends perpendicularly to the ammunition feeding direction;

a feed lever pivotably mounted on the top cover; and a feed pawl yoke pivotably mounted on the top cover.

4. The firearm receiver assembly of claim 3, wherein:

the feed pawl yoke is engaged with feed pawl bodies of the ammunition advancing mechanism; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

5. The firearm receiver assembly of claim 3, wherein:

the feed lever is pivotably attached at a first end portion thereof to the top cover to pivot about a feed lever pivot axis;

the feed pawl yoke is pivotably attached at a central portion thereof to the top cover to pivot about a feed pawl yoke pivot axis; and the ammunition advancing mechanism includes a feed pawl assembly slidably attached to the top cover to enable feed pawl bodies thereof to each move along a respective linear translation axis thereof extending parallel to the ammunition feeding direction.

6. The firearm receiver assembly of claim 5, wherein:

the feed pawl yoke is engaged with the feed pawl bodies; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

7. A firearm receiver assembly, comprising:

a receiver body;

an ammunition advancing mechanism operable to advance an ammunition feed belt along an ammunition feeding direction, wherein the ammunition advancing mechanism is a shuttle feed ammunition advancing mechanism; and a top cover including at least one mounting body and having the ammunition advancing mechanism mounted thereon, wherein the at least one mounting body enables the top cover to be pivotably attached to a mating interface portion of the receiver body, wherein the at least one mounting body defines a top cover pivot axis, wherein the top cover is pivotable about the top cover pivot axis, and wherein the top cover pivot axis extends perpendicularly to the ammunition feeding direction;

wherein the ammunition advancing mechanism includes a feed lever pivotably attached at a first end portion thereof to the top cover to pivot about a feed lever pivot axis; and wherein the feed lever includes a feed stud depressing portion at a second end portion thereof.

8. The firearm receiver assembly of claim 7, further comprising:

a feed lever pivotably mounted on the top cover; and a feed pawl yoke pivotably mounted on the top cover.

9. The firearm receiver assembly of claim 8, wherein:

the feed pawl yoke is engaged with feed pawl bodies of the ammunition advancing mechanism; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

10. A firearm receiver assembly, comprising:

a receiver body;

an ammunition advancing mechanism operable to advance an ammunition feed belt along an ammunition feeding direction, wherein the ammunition advancing mechanism is a shuttle feed ammunition advancing mechanism;

a top cover including at least one mounting body and having the ammunition advancing mechanism mounted thereon, wherein the at least one mounting body enables the top cover to be pivotably attached to a mating interface portion of the receiver body, wherein the at least one mounting body defines a top cover pivot axis, wherein the top cover is pivotable about the top cover pivot axis, and wherein the top cover pivot axis extends perpendicularly to the ammunition feeding direction; and a feed stud assembly including a feed stud housing and a feed stud at an upper surface of the feed stud housing;

wherein the ammunition advancing mechanism includes a feed lever pivotably attached to the top cover to pivot about a feed lever pivot axis;

wherein the feed stud housing is fixedly engageable with a bolt carrier slidably mounted within the receiver body for enabling the feed stud assembly to move in concert with the bolt carrier between a battery-enabling position and a recoil position;

wherein the feed stud is spring-biased to move between an extended position relative to the upper surface and a depressed position relative to the upper surface;

wherein the feed stud resides in a feed lever channel of the feed lever when the feed stud is in the extended position during movement of the bolt carrier between a battery-enabling position and a recoil position with the top cover in a closed position with respect to the receiver body;

wherein the feed lever is spring-biased to a reset position with the top cover in an open position with respect to the receiver body; and wherein the feed stud is retained in the depressed position by a feed stud depressing portion of the feed lever when the feed lever is in the reset position and the top cover in the closed position.

11. The firearm receiver assembly of claim 10, wherein:

the ammunition advancing mechanism includes a feed pawl yoke pivotably attached to the top cover and feed pawl bodies engaged with the feed pawl yoke; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

12. A firearm receiver assembly, comprising:

a receiver body, wherein the receiver body is an upper receiver body of a split receiver system; and an ammunition belt feeding apparatus including a top cover, an ammunition advancing mechanism, a feed pawl yoke pivotably mounted on the top cover and engaged with the ammunition advancing mechanism, and a feed lever pivotably mounted on the top cover and engaged with the feed pawl yoke, wherein the ammunition advancing mechanism is a shuttle feed ammunition advancing mechanism, wherein the top cover includes at least one mounting body and having the ammunition advancing mechanism mounted thereon, wherein the top cover is pivotably attached at a mounting portion thereof to a mounting portion of the receiver body for enabling the top cover to be pivotable about a top cover pivot axis extending parallel to a bore axis of the receiver body between an open position and a closed position with respect to the receiver body, wherein the at least one mounting body defines the top cover pivot axis, wherein the top cover is pivotable about the top cover pivot axis, and wherein the top cover pivot axis extends perpendicularly to an ammunition feeding direction of the ammunition advancing mechanism.

13. The firearm receiver assembly of claim 12, wherein the receiver body is an AR15 upper receiver body.

14. The firearm receiver assembly of claim 12, wherein:

the mounting portion of the receiver body is a unitarily-formed structure of the receiver body; and the top cover pivot axis extends through the mounting portion of the receiver body.

15. The firearm receiver assembly of claim 12, wherein:

the feed lever is movably engaged with the feed pawl yoke whereby pivotal movement of the feed lever about a pivot axis thereof causes a corresponding pivotal movement of the feed pawl yoke about a pivot axis thereof; and the feed pawl yoke is movably engaged with the ammunition advancing mechanism whereby said corresponding pivotal movement of the feed lever about the pivot axis thereof causes a corresponding linear movement of feed pawl bodies of the ammunition advancing mechanism.

16. The firearm receiver assembly of claim 12, wherein:

the feed pawl yoke is pivotably mounted on the top cover to pivot about a feed pawl yoke pivot axis extending perpendicular to an ammunition advancing mechanism mounting surface of the top cover; and the feed lever is pivotably mounted on the receiver body to pivot about a feed lever pivot axis extending in a fixed direction relative to the top cover pivot axis whereby the feed lever pivot axis remains in a fixed orientation relative to the top cover pivot axis as the top cover is pivoted about the top cover pivot axis.

17. The firearm receiver assembly of claim 12, wherein:

the feed lever is pivotably attached at a first end portion thereof to the top cover to pivot about a feed lever pivot axis; and the feed lever includes a feed stud depressing portion at a second end portion thereof.

18. The firearm receiver assembly of claim 17, wherein:

the feed pawl yoke is pivotably engaged with feed pawl bodies of the ammunition advancing mechanism; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

19. The firearm receiver assembly of claim 12, further comprising:

a bolt carrier within a bolt carrier receiving bore of the receiver body for enabling the bolt carrier to move between a battery-enabling position and a rearwardly displaced position; and a feed stud assembly including a feed stud housing and a feed stud at an upper surface of the feed stud housing, wherein the feed stud housing is fixedly attached to the bolt carrier for enabling the feed stud assembly to move in concert with the bolt carrier between the battery-enabling position and the rearwardly displaced position;

wherein the ammunition advancing mechanism includes a feed lever pivotably attached to the top cover;

wherein the feed stud is spring-biased to move between an extended position relative to the upper surface and a depressed position relative to the upper surface;

wherein the feed stud resides in a feed lever channel of the feed lever when the feed stud is in the extended position during movement of the bolt carrier between a battery-enabling position and a recoil position with the top cover in a closed position with respect to the receiver body;

wherein the feed lever is spring-biased to a reset position with the top cover in an open position with respect to the receiver body; and wherein the feed stud is retained in the depressed position by a feed stud depressing portion of the feed lever when the feed lever is in the reset position and the top cover in the closed position.

20. The firearm receiver assembly of claim 19, wherein:

the ammunition advancing mechanism includes a feed pawl yoke pivotably attached to the top cover and feed pawl bodies engaged with the feed pawl yoke; and the feed lever is pivotably engaged at a second end portion thereof to a first end portion to the feed pawl yoke whereby rotation of the feed lever about the feed lever pivot axis causes a corresponding movement of the feed pawl bodies each along a respective linear translation axis thereof extending parallel to the ammunition feeding direction.

21. The firearm receiver assembly of claim 19, further comprising:

guide bodies within a feed stud housing channel of the receiver body, wherein the feed stud housing is constrained between the guide bodies and wherein feed stud housing engaging surfaces of each guide bodies have a plurality of friction-reducing discontinuities formed therein.

22. The firearm receiver assembly of claim 21, wherein adjacent protrusions jointly form one of said friction-reducing discontinuities therebetween.

23. The firearm receiver assembly of claim 19, wherein:

the mounting portion of the receiver body is a unitarily-formed structure of the receiver body; and the top cover pivot axis extends through the mounting portion of the receiver body.

* * * * *